US011530361B2

(12) United States Patent
Kandel et al.

(10) Patent No.: US 11,530,361 B2
(45) Date of Patent: Dec. 20, 2022

(54) PYROLYSIS TAR CONVERSION

(71) Applicant: ExxonMobil Chemical Patents Inc., Baytown, TX (US)

(72) Inventors: Kapil Kandel, Humble, TX (US); Glenn A. Heeter, The Woodlands, TX (US); Teng Xu, Houston, TX (US); Giovanni S. Contello, Houston, TX (US); Krystle J. Emanuele, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 17/495,948

(22) Filed: Oct. 7, 2021

(65) Prior Publication Data

US 2022/0025277 A1 Jan. 27, 2022

Related U.S. Application Data

(62) Division of application No. 16/467,764, filed as application No. PCT/US2017/064117 on Dec. 1, 2017, now Pat. No. 11,168,268.

(60) Provisional application No. 62/525,345, filed on Jun. 27, 2017, provisional application No. 62/435,238, filed on Dec. 16, 2016.

(51) Int. Cl.

| | |
|---|---|
| ***C10G 45/72*** | (2006.01) |
| ***C10G 49/26*** | (2006.01) |
| ***C10C 1/19*** | (2006.01) |
| ***C10C 1/20*** | (2006.01) |
| ***C10G 1/00*** | (2006.01) |
| ***C10G 9/36*** | (2006.01) |
| ***C10G 47/36*** | (2006.01) |
| ***C10G 69/06*** | (2006.01) |

(52) U.S. Cl.

CPC ..... *C10G 49/26* (2013.01); *C10C 1/19* (2013.01); *C10C 1/205* (2013.01); *C10G 1/008* (2013.01); *C10G 9/36* (2013.01); *C10G 45/72* (2013.01); *C10G 47/36* (2013.01); *C10G 69/06* (2013.01); *C10G 2300/30* (2013.01); *C10G 2300/301* (2013.01); *C10G 2300/302* (2013.01); *C10G 2300/308* (2013.01); *C10G 2300/4075* (2013.01)

(58) Field of Classification Search

CPC ..... C10G 45/72; C10G 49/26; C10C 1/19; C10C 1/205

See application file for complete search history.

(56) References Cited

U.S. PATENT DOCUMENTS

| | | | | |
|---|---|---|---|---|
| 4,312,742 | A * | 1/1982 | Hayashi | C10C 3/00 208/50 |
| 5,871,634 | A | 2/1999 | Wiebe et al. | |
| 9,090,835 | B2 | 7/2015 | Beech, Jr. et al. | |
| 9,090,836 | B2 | 7/2015 | Brown et al. | |
| 9,102,884 | B2 | 8/2015 | Xu et al. | |
| 9,580,523 | B2 | 2/2017 | Wong et al. | |
| 9,637,694 | B2 | 5/2017 | Evans et al. | |
| 9,657,239 | B2 | 5/2017 | Beech, Jr. et al. | |
| 10,072,218 | B2 | 9/2018 | Chen et al. | |
| 2010/0288679 | A1 | 11/2010 | Himelfarb | |
| 2013/0081979 | A1 | 4/2013 | Brown et al. | |
| 2014/0061094 | A1 | 3/2014 | Xu | |
| 2014/0061095 | A1 | 3/2014 | Beech, Jr | |
| 2014/0061096 | A1 | 3/2014 | Brown et al. | |
| 2014/0061100 | A1 | 3/2014 | Lattner et al. | |
| 2014/0174980 | A1 | 6/2014 | Brown et al. | |
| 2015/0122701 | A1 | 5/2015 | Shih et al. | |
| 2015/0141717 | A1 | 5/2015 | Frey | |
| 2015/0315496 | A1 | 11/2015 | Souitanidis et al. | |
| 2015/0344785 | A1 | 12/2015 | Souitanidis et al. | |
| 2015/0344790 | A1 | 12/2015 | Ferrughelli et al. | |
| 2015/0353851 | A1 | 12/2015 | Buchanan | |
| 2015/0361354 | A1 | 12/2015 | Xu et al. | |
| 2015/0361359 | A1 | 12/2015 | Beech, Jr. et al. | |
| 2015/0368570 | A1 | 12/2015 | Beech, Jr. et al. | |
| 2016/0122667 | A1 | 5/2016 | Evans et al. | |
| 2016/0177205 | A1 | 6/2016 | Evans | |
| 2017/0002273 | A1 | 1/2017 | Rubin-Pitel et al. | |
| 2019/0016969 | A1 | 1/2019 | Kandel et al. | |
| 2019/0300803 | A1 | 10/2019 | Emanuele et al. | |
| 2019/0367822 | A1 | 12/2019 | Kandel et al. | |
| 2019/0367825 | A1 | 12/2019 | Heeter | |
| 2020/0063046 | A1 | 2/2020 | Kandel et al. | |
| 2020/0071627 | A1 | 3/2020 | Xu | |

FOREIGN PATENT DOCUMENTS

| | | | |
|---|---|---|---|
| WO | 2013/033580 | A | 3/2013 |
| WO | 2013/033582 | A | 3/2013 |
| WO | 2013/033590 | A | 3/2013 |
| WO | 2015/191236 | A | 12/2015 |

OTHER PUBLICATIONS

Process Pro Eric "Mitigating Hydroprocessing Reactor Fouling", Refiner Link, Jun. 16, 2014. KURL: http://www.refineriink.com/blog/Mitigating_Hydroprocessing_Reactor_Fouling/).

U.S. Appl. No. 62/380,538, filed Aug. 29, 2016.

* cited by examiner

*Primary Examiner* — Randy Boyer

(57) ABSTRACT

This invention relates to a process for determining the suitability of pyrolysis tar, such as steam cracker tar, for upgrading using hydroprocessing without excessive fouling of the hydroprocessing reactor. A pyrolysis tar is sampled, the sample is analyzed to determine one or more characteristics of the tar related to tar reactivity, and the analysis is used to determine conditions under which the tar can be blended, pre-treated, and/or hydroprocessed.

12 Claims, 4 Drawing Sheets

PYROLYSIS TAR CONVERSION

PRIORITY CLAIM

Cross-Reference of Related Applications

This application is a divisional application of Ser. No. 16/467,764 having a filing date of Jun. 7, 2019, which is a US national phase application of PCT Application Serial No. PCT/US2017/064117 having a filing date of Dec. 1, 2017, which, in turn, claims priority to and the benefit of U.S. Provisional Application No. 62/525,345 having a filing date of Jun. 27, 2017 and U.S. Provisional Application No. 62/435,238 having a filing date of Dec. 16, 2016, the contents of all of which are incorporated by reference in their entireties.

RELATED APPLICATIONS

This application is related to the following applications: U.S. patent application Ser. No. 15/829,034, filed Dec. 1, 2017; U.S. Patent Application Ser. No. 62/561,478, filed Sep. 21, 2017; PCT Patent Application No. PCT/US2017/064128, filed Dec. 1, 2017; U.S. Patent Application Ser. No. 62/571,829, filed Oct. 13, 2017; PCT Patent Application No. PCT/US2017/064140, filed Dec. 1, 2017; PCT Patent Application No. PCT/US2017/064165, filed Dec. 1, 2017; PCT Patent Application No. PCT/US2017/064176, filed Dec. 1, 2017, which are incorporated by reference in their entireties.

FIELD

This invention relates to a process for determining the suitability of pyrolysis tar, such as steam cracker tar, for upgrading using hydroprocessing without excessive fouling of the hydroprocessing reactor. The invention also relates to sampling the pyrolysis tar, analyzing the sample, and using the analysis to determine conditions under which the tar can be blended, pre-treated, and/or hydroprocessed.

BACKGROUND

Pyrolysis processes, such as steam cracking, are utilized for converting saturated hydrocarbons to higher-value products such as light olefins, e.g., ethylene and propylene. Besides these useful products, hydrocarbon pyrolysis can also produce a significant amount of relatively low-value heavy products, such as pyrolysis tar. When the pyrolysis is conducted by steam cracking, the pyrolysis tar is identified as steam-cracker tar ("SCT").

Pyrolysis tar is a high-boiling, viscous, reactive material comprising complex molecules and macromolecules that can foul equipment and conduits contacting the tar. Pyrolysis tar typically comprises compounds which include hydrocarbon rings, e.g., hydrocarbons rings having hydrocarbon side chains, such as methyl and/or ethyl side chains. Depending to some extent on features such as molecular weight, molecules and aggregates present in the pyrolysis tar can be both relatively non-volatile and paraffin insoluble, e.g., pentane insoluble and heptane-insoluble. Particularly challenging pyrolysis tars contain >1 wt. % toluene insoluble compounds. Such toluene insoluble are typically high molecular weight compounds, e.g., multi-ring structures that are also referred to as tar heavies ("TH"). These high molecular weight molecules can be generated during the pyrolysis process, and their high molecular weight leads to high viscosity, which makes the tar difficult to process and transport.

Blending pyrolysis tar with lower viscosity hydrocarbons has been proposed for improved processing and transport of pyrolysis tar. However, when blending heavy hydrocarbons, fouling of processing and transport facilities can occur as a result of precipitation of high molecular weight molecules, such as asphaltenes. See, e.g., U.S. Pat. No. 5,871,634, which is incorporated herein by reference in its entirety. In order to mitigate asphaltene precipitation, methods to guide the blending process, e.g., methods have been developed which include determining an Insolubility Number ("$I_N$") and/or Solvent Blend Number ("$S_{BN}$") for the blend and/or components thereof. Successful blending can be accomplished with little or substantially no asphaltene precipitation by combining the components in order of decreasing $S_{BN}$, so that the $S_{BN}$ of the blend is greater than the $I_N$ of any component of the blend. Pyrolysis tars generally have high $S_{BN}$>135 and high $I_N$>80 making them difficult to blend with other heavy hydrocarbons without precipitating asphaltenes Pyrolysis tars having $I_N$>100, e.g., >110, e.g., >130, are particularly difficult to blend without phase separation occurring.

Attempts at pyrolysis tar hydroprocessing to reduce viscosity and improve both $I_N$ and $S_{BN}$ have been attempted, but challenges remain—primarily resulting from fouling of process equipment. For example, hydroprocessing of neat SCT results in rapid catalyst deactivation when the hydroprocessing is carried out at a temperature in the range of about 250° C. to 380° C., a pressure in the range of about 5400 kPa to 20,500 kPa, using a conventional hydroprocessing catalyst containing one or more of Co, Ni, or Mo. This deactivation has been attributed to the presence of TH in the SCT, which leads to the formation of undesirable deposits (e.g., coke deposits) on the hydroprocessing catalyst and the reactor internals. As the amount of these deposits increases, the yield of the desired upgraded pyrolysis tar (e.g., upgraded SCT) decreases and the yield of undesirable byproducts increases. The hydroprocessing reactor pressure drop also increases, often to a point where the reactor becomes inoperable before a desired reactor run length can be achieved.

One approach taken to overcome these difficulties is disclosed in International Patent Application Publication No. WO 2013/033580, which is incorporated herein by reference in its entirety. The application discloses hydroprocessing SCT in the presence of a utility fluid comprising a significant amount of single and multi-ring aromatics to form an upgraded pyrolysis tar product. The upgraded pyrolysis tar product generally has a decreased viscosity, decreased atmospheric boiling point range, and increased hydrogen content over that of the pyrolysis tar feed, resulting in improved compatibility with fuel oil and other common blend-stocks. Additionally, efficiency advances involving recycling a portion of the upgraded pyrolysis tar product as utility fluid are described in International Patent Application Publication No. WO 2013/033590 which is also incorporated herein by reference in its entirety.

Another improvement, disclosed in U.S. Patent Application Publication No. 2015/0315496, which is incorporated herein by reference in its entirety, includes separating and recycling a mid-cut utility fluid from the upgraded pyrolysis tar product. The utility fluid comprises ≥10.0 wt. % aromatic and non-aromatic ring compounds and each of the following: (a) ≥1.0 wt. % of 1.0 ring class compounds; (b) ≥5.0 wt. % of 1.5 ring class compounds; (c) ≥5.0 wt. % of 2.0 ring class compounds; and (d) ≥0.1 wt. % of 5.0 ring class compounds. Improved utility fluids are also disclosed in the following patent applications, each of which is incorporated by references in its entirety. U.S. Patent Application Publication No. 2015/0368570 discloses separating and recycling a utility fluid from the upgraded pyrolysis tar product. The utility fluid contains 1-ring and/or 2-ring aromatics and has a final boiling point ≤430° C. U.S. Patent Application Publication No. 2016/0122667 discloses utility fluid which contains 2-ring and/or 3-ring aromatics and has solubility blending number ($S_{BN}$)≥120.

Despite these advances, there remains a need for further improvements in the hydroprocessing of pyrolysis tars, especially those having high $I_N$ values, which allow the production of upgraded tar product having lower viscosity at appreciable hydroprocessing reactor run lengths.

SUMMARY

It has been discovered that pyrolysis tars can be hydroprocessed for an appreciable reactor run length without undue reactor fouling, provided the tar has a reactivity that does not exceed a reference reactivity level. Pyrolysis tar reactivity ("$R_T$") can be determined from the tar's free radical content profile, e.g., using electron resonance spin ("ESR"). Pyrolysis tar reactivity can also be determined from the tar's aliphatic olefin content, as indicated by bromine number ("BN") or iodine number measurements. More particularly, it has been found that for a wide range of desirable pyrolysis tar hydroprocessing conditions, a reference reactivity level can be specified for the pyrolysis tar. The reference reactivity value ("$R_{Ref}$") can be pre-determined and corresponds to the greatest reactivity a pyrolysis tar can have without undue reactor fouling occurring during hydroprocessing. Accordingly, the reactivity $R_T$ of a pyrolysis tar available for processing can be compared with $R_{Ref}$, and processing decisions can be based on the comparison. For instance, a reference reactivity value, as determined by ESR or BN, can be specified for comparison with a reactivity $R_T$ of a particular pyrolysis tar, where $R_T$ is also determined by ESR or BN. When $R_T$ is ≤$R_{Ref}$, and particularly when $R_T$ is ≤18 Bromine Number units, e.g., ≤12 Bromine Number units, the pyrolysis tar can be hydroprocessed with decreased reactor fouling and increased run-lengths. Advantageously, $R_T$ can be determined using a suitably prepared pyrolysis tar sample at ambient (e.g., 25° C.) temperature, even though the sample is obtained from a pyrolysis tar source, such as a tar drum, having a much greater temperature, e.g., in a range of about 140° C. to 350° C. This greatly simplifies the measurement of $R_T$.

Accordingly, certain aspects of the invention relate to a process for upgrading a reactive hydrocarbon feed. The feed can be a hydrocarbon-containing mixture such as pyrolysis tar, e.g., SCT. At least 70 wt. % of the hydrocarbon-containing mixture has a normal boiling point of at least 290° C. In accordance with the process, a sample is isolated from the hydrocarbon mixture. The sample's reactivity $R_T$ is determined, and $R_T$ is compared to a predetermined reference reactivity $R_{Ref}$. When $R_T$ exceeds $R_{Ref}$, the hydrocarbon-containing mixture, one or more of the following procedures is carried out:

(i) At least a portion of the hydrocarbon-containing mixture is thermally treated (e.g., heat-soaked) one or more times until $R_T$ is ≤$R_{Ref}$, after which at least a portion of the thermally treated hydrocarbon-containing mixture is conducted as pyrolysis tar feed to a hydroprocessing stage for hydroprocessing. The thermal treatment includes maintaining the hydrocarbon-containing mixture at a temperature in the range of from 150° C. to 350° C. for a time $t_{HS}$ of at least 1 minute.

(ii) At least a portion of the hydrocarbon-containing mixture is blended with a sufficient amount of at least a second hydrocarbon-containing mixture to achieve an $R_T$ that does not exceed $R_{Ref}$, after which at least a portion of the blend is conducted as pyrolysis tar feed to a hydroprocessing stage for hydroprocessing. At least 70 wt. % of the second hydrocarbon-containing mixture has a normal boiling point of at least 290° C.

(iii) At least a portion of the hydrocarbon-containing mixture is conducted as pyrolysis tar feed to a hydroprocessing stage for hydroprocessing under Mild Hydroprocessing Conditions.

(iv) At least a portion of the hydrocarbon-containing mixture is conducted away. When $R_T$ does not exceed $R_{Ref}$, the hydrocarbon-containing mixture can be conducted directly to the hydroprocessing without the thermal treatment, without blending, and without the need for Mild Hydroprocessing Conditions during the hydroprocessing.

BRIEF DESCRIPTION OF THE DRAWINGS

The drawings are for illustrative purposes only and are not intended to limit the scope of the present invention.

DETAILED DESCRIPTION

Figure 1:
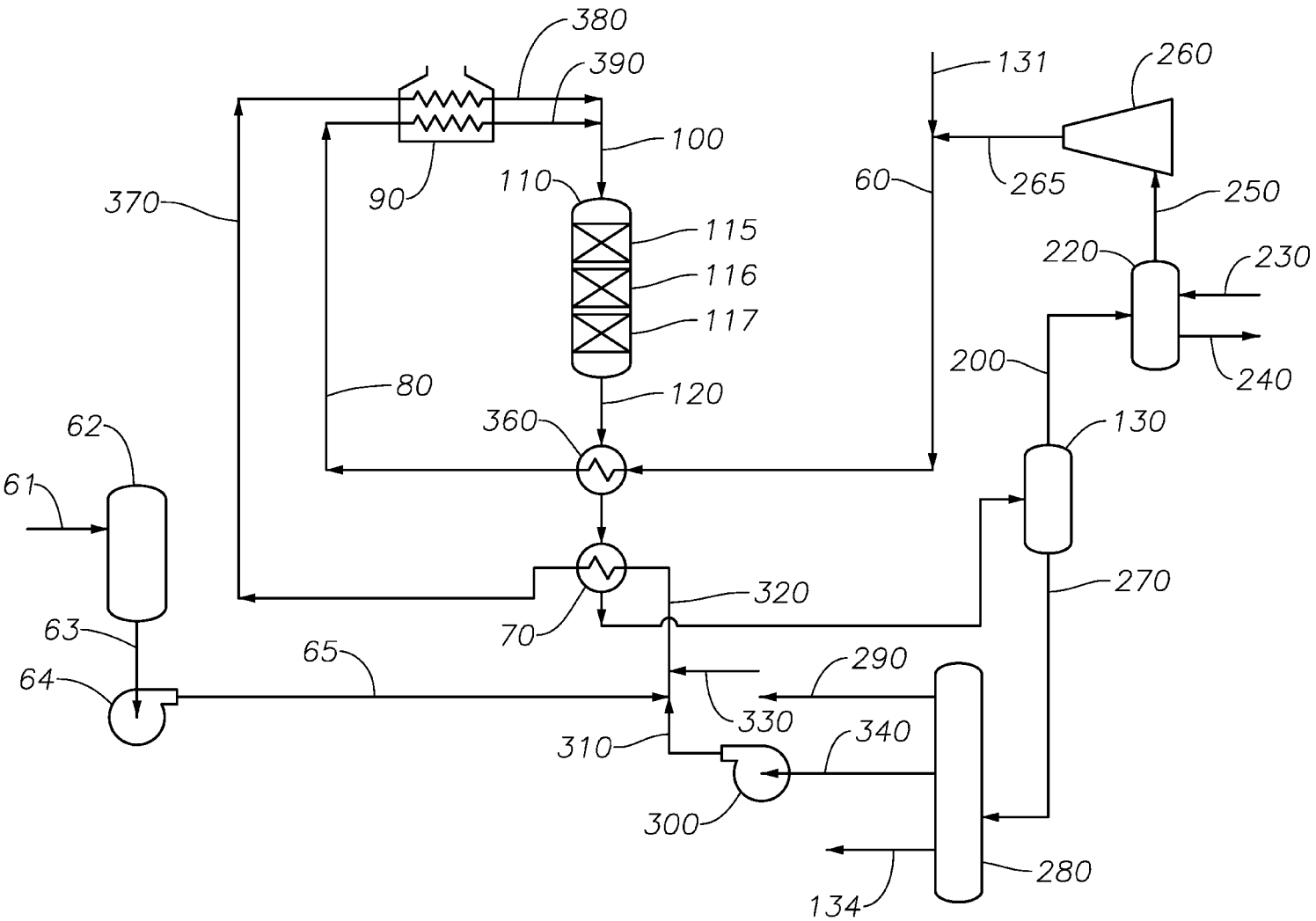
FIG. 1 is a schematic representing a hydroprocessing reaction sequence.

A pyrolysis tar is evaluated for its reactivity to evaluate its potential for fouling the reactor at desired hydroprocessing conditions. The tar's reactivity is compared to a predetermined reference activity. Pyrolysis tars having a reactivity that does not exceed the reference activity can be conducted as pyrolysis tar feed to a hydroprocessing stage operating under Standard Hydroprocessing Conditions or Mild Hydroprocessing Conditions to produce a hydroprocessed pyrolysis tar. Pyrolysis tars having a reactivity that exceeds the reference activity are (i) subjected to additional processing before the hydroprocessing and/or subjected to Mild Hydroprocessing Conditions during the hydroprocessing or (ii) conducted away.

A pyrolysis tar's free radical content is an indication of its reactivity. Free radical content can be evaluated, e.g., by sampling the pyrolysis tar, such as at a temperature $T_1$≤350° C. The sample's temperature is raised to a predetermined temperature $T_2$ that is at least 10° C. greater than $T_1$, and the sample's temperature is maintained at a temperature within about +/−5° C. of $T_2$ for predetermined period of time $t_h$. Typically, $T_2$ is substantially the same as the desired hydroprocessing temperature, and $t_h$ is substantially the same as the time during which the tar is exposed to hydroprocessing conditions during the hydroprocessing. Following this, the sample is cooled to a temperature $T_3$≤$T_1$, and the reactivity $R_T$ of the cooled sample is measured, e.g., using ESR, BN, etc. The tar's reactivity $R_T$ is compared to the pre-determined reference value $R_{Ref}$. Typically $R_T$ and $R_{Ref}$ are determined using substantially the same methods and process conditions, e.g., using BN at substantially the same $T_1$, $T_2$, $T_3$, and $t_h$, but this is not required. Those skilled in the art will appreciate that a correlation between measurement output and tar reactivity can be established for each of the free radical measurement methods (e.g., ESR and BN) at various measurement conditions, which if carried out would permit a comparison of $R_T$ as determined by one measurement method (e.g., ESR) with $R_{Ref}$ determined by another method (e.g., BN).

The comparison of $R_T$ and $R_{Ref}$ is used to select from among various processing options for the pyrolysis tar. For example, the comparison can be used to determine whether (a) the sampled pyrolysis tar is a suitable candidate for hydroprocessing under the specified Standard Hydroprocessing Conditions, e.g., when $R_T$ is $\leq R_{Ref}$, such as $R_T$ is $\leq 0.5*R_{Ref}$, or $R_T$ is $\leq 0.1*R_{Ref}$. When $R_T$ is $>R_{Ref}$, the available processing options include one or more of (a) subjecting the tar to the specified Mild Hydroproces sing Conditions, (b) further processing of the tar to achieve an $R_T$ is $\leq R_{Ref}$, and then hydroprocessing the further-processed tar, and/or (c) conducting the tar away without hydroprocessing. For example, the pyrolysis tar can be conducted away when (i) the value of a hydroprocessed tar produced using Mild Hydroprocessing Conditions is not sufficient to justify the cost of the hydroprocessing and/or (ii) the value of a hydroprocessed tar is not sufficient to justify the cost of the further treatment.

Further processing of the pyrolysis tar can be carried out if desired, and can include one of more of (i) at least one blending operation and (ii) at least one thermal treatment. For example, should $R_T$ exceed $R_{Ref}$, the pyrolysis tar may be blended with a second pyrolysis tar to decrease the reactivity of the blended tar into a range that does not exceed $R_{Ref}$. The blend can then be conducted as pyrolysis tar feed to a hydroprocessing reactor for hydroprocessing. A plurality of pyrolysis tars, including a plurality of SCTs, may be blended to produce a blended pyrolysis tar with a specific free radical profile, e.g., one exhibiting a blended sample $R_T \leq R_{Ref}$. The blending can be carried out before and/or during the hydroprocessing. For example, a blend of pyrolysis tars having an $R_T \leq R_{Ref}$ can be conducted to hydroprocessing as pyrolysis tar feed. Typically, the hydroprocessing of the pyrolysis tar feed is carried out in the presence of at least one utility fluid. When the hydroprocessing is carried out in more than one hydroprocessing stage, the hydroprocessing of at least one of the stages is carried out in the presence of the utility fluid. The pyrolysis tar feed can be combined with utility fluid at any convenient time, e.g., before and/or during hydroprocessing. When the pyrolysis tar feed includes a blend of one or more pyrolysis tars, the pyrolysis tar feed may be combined with utility fluid at any time, e.g., one or more of before, during, and after blending.

Instead of or in addition to blending, the hydroprocessing can be carried out under the specified Mild Hydroprocessing Conditions, which when used decreases the severity of the reaction and/or slows the reaction as compared to hydroprocessing under the specified Standard Hydroprocessing Conditions. When a pyrolysis tar's $R_T$ exceeds $R_{Ref}$, hydroprocessing the tar under the specified Mild Hydroprocessing Conditions lessens the potential for fouling during the hydroprocessing, but typically produces a hydroprocessed tar having properties that are not as favorable as those of hydroprocessed tars produced using the specified Standard Hydroprocessing Conditions.

Certain methods for evaluating pyrolysis tar reactivity, pyrolysis tar blending, thermal treatments of pyrolysis tar, pyrolysis tar hydroprocessing under Standard Hydroprocessing Conditions and Mild Hydroprocessing Conditions will now be described in more detail. The invention is not limited to these methods, and this descriptions is not meant to foreclose the use of other methods, apparatus, systems, etc., within the broader scope of the invention. Reference will be made to the following defined terms in this description and appended claims.

The term "pyrolysis tar" means (a) a mixture of hydrocarbons having one or more aromatic components and optionally (b) non-aromatic and/or non-hydrocarbon molecules, the mixture being derived from hydrocarbon pyrolysis, with at least 70% of the mixture having a boiling point at atmospheric pressure that is ≥ about 550° F. (290° C.). Certain pyrolysis tars have an initial boiling point ≥200° C. For certain pyrolysis tars, ≥90.0 wt. % of the pyrolysis tar has a boiling point at atmospheric pressure ≥550° F. (290° C.). Pyrolysis tar can comprise, e.g., ≥50.0 wt. %, e.g., ≥75.0 wt. %, such as ≥90.0 wt. %, based on the weight of the pyrolysis tar, of hydrocarbon molecules (including mixtures and aggregates thereof) having (i) one or more aromatic components, and (ii) a number of carbon atoms ≥ about 15. Pyrolysis tar generally has a metals content, $\leq 1.0\times10^3$ ppmw, based on the weight of the pyrolysis tar, which is an amount of metals that is far less than that found in crude oil (or crude oil components) of the same average viscosity. "SCT" means pyrolysis tar obtained from steam cracking.

"Aliphatic olefin component" or "aliphatic olefin content" means the portion of the tar that contains hydrocarbon molecules having olefin unsaturation (at least one unsaturated carbon that is not an aromatic unsaturation) where the hydrocarbon may or may not also have aromatic unsaturation. For instance, a vinyl hydrocarbon like styrene, if present in the pyrolysis tar, would be included aliphatic olefin content.

"Tar Heavies" (TH) are a product of hydrocarbon pyrolysis having an atmospheric boiling point ≥565° C. and comprising ≥5.0 wt. % of molecules having a plurality of aromatic cores based on the weight of the product. The TH are typically solid at 25° C. and generally include the fraction of SCT that is not soluble in a 5:1 (vol.:vol.) ratio of n-pentane: SCT at 25° C. TH generally includes asphaltenes and other high molecular weight molecules.

Aspects of the invention will now be described which include (i) establishing an $R_{Ref}$ for desired hydroprocessing conditions, (ii) obtaining a sample of a pyrolysis tar, (iii) measuring $R_T$ of a suitably-prepared sample of the pyrolysis tar, and (iv) comparing $R_T$ to $R_{Ref}$. For tars having an $R_T > R_{Ref}$, certain aspects will be described which include exposing at least a portion of the tar to one or more thermal treatments (e.g., heat soaks) to decrease the tar's $R_T$ into a range that does not exceed $R_{Ref}$. As an alternative or in addition to these aspects, other aspects will be described which include blending at least a portion of a pyrolysis tar having an $R_T > R_{Ref}$ with at least a second pyrolysis tar to achieve a desired radical profile for the blend, as indicated, e.g., by the blend having an $R_T$ that does not exceed $R_{Ref}$. As an alternative or in addition to any of the foregoing aspects, other aspects will be described which include hydroprocessing at least a portion of a pyrolysis tar (or a blend of pyrolysis tars) having an $R_T > R_{Ref}$ using Mild Hydroprocessing Conditions. Alternatively or in addition to any of the foregoing aspects, at least a portion of a tar or tar blend having an $R_T > R_{Ref}$ can be conducted away without hydroprocessing. Representative pyrolysis tars that may benefit from the foregoing processing will now be described in more detail. The invention is not limited to these pyrolysis tars, and this description is not meant to foreclose other pyrolysis tars within the broader scope of the invention.

Pyrolysis Tar

Pyrolysis tar is a product or by-product of hydrocarbon pyrolysis, e.g., steam cracking. Effluent from the pyrolysis is typically in the form of a mixture comprising unreacted feed, unsaturated hydrocarbon produced from the feed during the pyrolysis, and pyrolysis tar. The pyrolysis tar typically comprises ≥90 wt. %, of the pyrolysis effluent's molecules having an atmospheric boiling point of ≥290° C. Besides hydrocarbon, the feed to pyrolysis optionally further comprise diluent, e.g., one or more of nitrogen, water, etc. Steam cracking, which produces SCT, is a form of pyrolysis which uses a diluent comprising an appreciable amount of steam. Steam cracking will now be described in more detail. The invention is not limited to pyrolysis tars produced by steam cracking, and this description is not meant to foreclose producing pyrolysis tar by other pyrolysis methods within the broader scope of the invention.

Steam Cracking

A steam cracking plant typically comprises a furnace facility for producing steam cracking effluent and a recovery facility for removing from the steam cracking effluent a plurality of products and by-products, e.g., light olefin and pyrolysis tar. The furnace facility generally includes a plurality of steam cracking furnaces. Steam cracking furnaces typically include two main sections: a convection section and a radiant section, the radiant section typically containing fired heaters. Flue gas from the fired heaters is conveyed out of the radiant section to the convection section. The flue gas flows through the convection section and is then conducted away, e.g., to one or more treatments for removing combustion by-products such as $NO_x$. Hydrocarbon is introduced into tubular coils (convection coils) located in the convection section. Steam is also introduced into the coils, where it combines with the hydrocarbon to produce a steam cracking feed. The combination of indirect heating by the flue gas and direct heating by the steam leads to vaporization of at least a portion of the steam cracking feed's hydrocarbon component. The steam cracking feed containing the vaporized hydrocarbon component is then transferred from the convection coils to tubular radiant tubes located in the radiant section. Indirect heating of the steam cracking feed in the radiant tubes results in cracking of at least a portion of the steam cracking feed's hydrocarbon component. Steam cracking conditions in the radiant section, can include, e.g., one or more of (i) a temperature in the range of 760° C. to 880° C., (ii) a pressure in the range of from 1.0 to 5.0 bars (absolute), or (iii) a cracking residence time in the range of from 0.10 to 2.0 seconds.

Steam cracking effluent is conducted out of the radiant section and is quenched, typically with water or quench oil. The quenched steam cracking effluent ("quenched effluent") is conducted away from the furnace facility to the recovery facility, for separation and recovery of reacted and unreacted components of the steam cracking feed. The recovery facility typically includes at least one separation stage, e.g., for separating from the quenched effluent one or more of light olefin, steam cracker naphtha, steam cracker gas oil, SCT, water, light saturated hydrocarbon, molecular hydrogen, etc.

Steam cracking feed typically comprises hydrocarbon and steam, e.g., ≥10.0 wt. % hydrocarbon, based on the weight of the steam cracking feed, e.g., ≥25.0 wt. %, ≥50.0 wt. %, such as ≥65 wt. %. Although the hydrocarbon can comprise one or more light hydrocarbons such as methane, ethane, propane, butane etc., it can be particularly advantageous to include a significant amount of higher molecular weight hydrocarbon. While doing so typically decreases feed cost, steam cracking such a feed typically increases the amount of SCT in the steam cracking effluent. One suitable steam cracking feed comprises ≥1.0 wt. %, e.g., ≥10 wt. %, such as ≥25.0 wt. %, or ≥50.0 wt. % (based on the weight of the steam cracking feed) of hydrocarbon compounds that are in the liquid and/or solid phase at ambient temperature and atmospheric pressure.

The steam cracking feed comprises water and hydrocarbon. The hydrocarbon typically comprises ≥10.0 wt. %, e.g., ≥50.0 wt. %, such as ≥90.0 wt. % (based on the weight of the hydrocarbon) of one or more of naphtha, gas oil, vacuum gas oil, waxy residues, atmospheric residues, residue admixtures, or crude oil; including those comprising ≥ about 0.1 wt. % asphaltenes. When the hydrocarbon includes crude oil and/or one or more fractions thereof, the crude oil is optionally desalted prior to being included in the steam cracking feed. A crude oil fraction can be produced by separating atmospheric pipestill ("APS") bottoms from a crude oil followed by vacuum pipestill ("VPS") treatment of the APS bottoms.

Suitable crude oils include, e.g., high-sulfur virgin crude oils, such as those rich in polycyclic aromatics. For example, the steam cracking feed's hydrocarbon can include ≥90.0 wt. % of one or more crude oils and/or one or more crude oil fractions, such as those obtained from an atmospheric APS and/or VPS; waxy residues; atmospheric residues; naphthas contaminated with crude; various residue admixtures; and SCT.

SCT is typically removed from the quenched effluent in one or more separation stages, e.g., as a bottoms stream from one or more tar drums. Such a bottoms stream typically comprises ≥90.0 wt. % SCT, based on the weight of the bottoms stream. The SCT can have, e.g., a boiling range ≥ about 550° F. (290° C.) and can comprise molecules and mixtures thereof having a number of carbon atoms ≥ about 15. Typically, quenched effluent includes ≥1.0 wt. % of $C_2$ unsaturates and ≥0.1 wt. % of TH, the weight percents being based on the weight of the pyrolysis effluent. It is also typical for the quenched effluent to comprise ≥0.5 wt. % of TH, such as ≥1.0 wt. % TH.

Representative SCTs will now be described in more detail. The invention is not limited to these SCTs, and this description is not meant to foreclose the processing of other pyrolysis tars within the broader scope of the invention.

Steam Cracker Tar

Conventional separation equipment can be used for separating SCT and other products and by-products from the quenched steam cracking effluent, e.g., one or more flash drums, knock out drums, fractionators, water-quench towers, indirect condensers, etc. Suitable separation stages are described in U.S. Pat. No. 8,083,931, for example. SCT can be obtained from the quenched effluent itself and/or from one or more streams that have been separated from the quenched effluent. For example, SCT can be obtained from a steam cracker gas oil stream and/or a bottoms stream of the steam cracker's primary fractionator, from flash-drum bottoms (e.g., the bottoms of one or more flash drums located downstream of the pyrolysis furnace and upstream of the primary fractionator), or a combination thereof. Certain SCTs are a mixture of primary fractionator bottoms and tar knock-out drum bottoms.

A typical SCT stream from one or more of these sources generally contains ≥90.0 wt. % of SCT, based on the weight of the stream, e.g., ≥95.0 wt. %, such as ≥99.0 wt. %. More than 90 wt. % of the remainder of the SCT stream's weight (e.g., the part of the stream that is not SCT, if any) is typically particulates. The SCT typically includes ≥50.0 wt. %, e.g., ≥75.0 wt. %, such as ≥90.0 wt. % of the quenched effluent's TH, based on the total weight TH in the quenched effluent.

The TH are typically in the form of aggregates which include hydrogen and carbon and which have an average size in the range of 10.0 nm to 300.0 nm in at least one dimension and an average number of carbon atoms ≥50. Generally, the TH comprise ≥50.0 wt. %, e.g., ≥80.0 wt. %, such as ≥90.0 wt. % of aggregates having a C:H atomic ratio in the range of from 1.0 to 1.8, a molecular weight in the range of 250 to 5000, and a melting point in the range of 100° C. to 700° C.

Representative SCTs typically have (i) a TH content in the range of from 5.0 wt. % to 40.0 wt. %, based on the weight of the SCT, (ii) an API gravity (measured at a temperature of 15.8° C.) of ≤8.5° API, such as ≤8.0° API, or ≤7.5° API; and (iii) a 50° C. viscosity in the range of 200 cSt to $1.0\times10^7$ cSt, as determined by A.S.T.M. D445. The SCT can have, e.g., a sulfur content that is >0.5 wt. %, e.g., in the range of 0.5 wt. % to 7.0 wt. %, based on the weight of the SCT. In aspects where steam cracking feed does not contain an appreciable amount of sulfur, the SCT can comprise ≤0.5 wt. % sulfur, e.g., ≤0.1 wt. %, such as ≤0.05 wt. % sulfur, based on the weight of the SCT.

The SCT can have, e.g., (i) a sulfur content in the range of 0.5 wt. % to 7.0 wt. %, based on the weight of the SCT; (ii) a TH content in the range of from 5.0 wt. % to 40.0 wt. %, based on the weight of the SCT; (iii) a density at 15° C. in the range of 1.01 g/cm$^3$ to 1.19 g/cm$^3$, e.g., in the range of 1.07 g/cm$^3$ to 1.18 g/cm$^3$; and (iv) a 50° C. viscosity in the range of 200 cSt to $1.0\times10^7$ cSt. The specified hydroprocessing is particularly advantageous for SCTs having density at 15° C. that is ≥1.10 g/cm$^3$, e.g., ≥1.12 g/cm$^3$, ≥1.14 g/cm$^3$, ≥1.16 g/cm$^3$, or ≥1.17 g/cm$^3$. Optionally, the SCT has a kinematic viscosity at 50° C.≥$1.0\times10^4$ cSt, such as ≥$1.0\times10^5$ cSt, or ≥$1.0\times10^6$ cSt, or even ≥$1.0\times10^7$ cSt. Optionally, the SCT has an $I_N$>80 and >70 wt. % of the pyrolysis tar's molecules have an atmospheric boiling point of ≥290° C.

Optionally, the SCT has a normal boiling point ≥290° C., a viscosity at 15° C.≥$1\times10^4$ cSt, and a density ≥1.1 g/cm$^3$. The SCT can be a mixture which includes a first SCT and one or more additional pyrolysis tars, e.g., a combination of the first SCT and one or more additional SCTs. When the SCT is a mixture, it is typical for at least 70 wt. % of the mixture to have a normal boiling point of at least 290° C., and include free radicals which contribute to the tar's reactivity under hydroprocessing conditions. When the mixture comprises a first and second pyrolysis tars (one or more of which is optionally an SCT) ≥90 wt. % of the second pyrolysis tar optionally has a normal boiling point ≥290° C.

It has been found that an increase in reactor fouling occurs during hydroprocessing when the SCT contains an excessive amount of free radicals. In order to lessen the amount of reactor fouling as might occur during SCT hydroprocessing in the presence of the specified utility fluid under the specified hydroprocessing conditions, it is beneficial for an SCT feed to the hydroprocessor to have an olefin content of ≤10.0 wt. % (based on the weight of the SCT), e.g., ≤5.0 wt. %, such as ≤2.0 wt. %. More particularly, it has been observed that less reactor fouling occurs during the hydroprocessing when the SCT has (i) an amount of vinyl aromatics of ≤5.0 wt. % (based on the weight of the SCT), e.g., ≤3 wt. %, such as ≤2.0 wt. % and/or (ii) an amount of aggregates which incorporate vinyl aromatics of ≤5.0 wt. % (based on the weight of the SCT), e.g., ≤3 wt. %, such as ≤2.0 wt. %. Certain aspects of the invention are based in part on the development of a process which includes steps for (i) determining the reactivity $R_T$ of an SCT, (ii) comparing the SCT's $R_T$ to a pre-determined reference reactivity $R_{Ref}$, and then using the comparison to select processing options for the SCT which lessen the free radical content. These aspects will now be described in more detail. The invention is not limited to these aspects, and this description is not meant to foreclose other aspects within the broader scope of the invention.

Determining Pyrolysis Tar Reactivity

The fouling tendency (e.g., the reactivity) of a pyrolysis tar during hydroprocessing varies from one batch to another depending upon, for example, the pyrolysis tar's thermal history during pyrolysis and thereafter. Pyrolysis tar reactivity has been found to be well-correlated with the tar's free radical content, particularly the tar's aliphatic olefin content, and more particularly the tar's vinyl aromatic content. Reactivity $R_T$ and reference reactivity $R_{Ref}$ can be determined by any convenient method, including conventional methods such as ESR and BN. Typically, the method selected for measuring $R_T$ is substantially the same as that utilized for establishing $R_{Ref}$, but this is not required.

Determining $R_T$ by ESR

The tendency of a pyrolysis tar to foul a hydroprocessing reactor under hydroprocessing conditions has been found to be correlated with the tar's free radical content as measured at ambient temperature by ESR. Accordingly, in certain aspects a pyrolysis tar, e.g., an SCT, is provided at a temperature in a range of about 140° C. to 350° C. A sample is withdrawn from the tar. Those skilled in the art will appreciate that the amount of tar in the sample is not critical provided the sample contains sufficient tar for carrying out the ESR measurement. The sample is heated to a temperature that exceeds $T_1$ by at least 10° C. for a heating time $t_h$, after which time the sample is cooled to a temperature $T_3$ that is ≤$T_1$. An ESR measurement is used to determine the free radical content of the cooled sample. The ESR measurement can be carried out at a temperature ≤$T_1$, e.g., at ambient temperature, typically about 25° C. The ESR measurement of the cooled sample can be carried out as follows.

A suitable amount, e.g., 5.5±1 mg, of the cooled pyrolysis tar is loaded into a glass capillary having a diameter of about 1.1 mm. The sample occupies about 10 mm of the capillary's length. Although the capillary can be loaded at any convenient temperature $T_1$≤350° C., it can be beneficial to expose the pyrolysis tar to a temperature of 100° C. for 1 hr. in an oven in order to increase the viscosity of the tar for easier capillary loading. The loaded capillary is weighed and then placed inside a glass tube of 2 mm diameter×30 mm length. The glass tube is purged with nitrogen for at least about 15 seconds and then sealed by exposing each end of the tube to a burner. Purging is believed to effectively limit the influence of oxygen on the free radical measurement.

While not wishing to be bound by any theory or model, it is believed that heating the pyrolysis tar sample to a temperature $T_2$≥$T_1$+10° C., for the specified heating time $t_h$ produces additional free radicals in the sample, which are then "frozen-in" when the sample is cooled. Heating rate is adjusted so that the sample increases in temperature to substantially achieve thermal equilibrium at temperature $T_2$ at the end of a first ramp time that is ≤$t_h$, e.g., ≤0.75*$t_h$, such as ≤0.5*$t_h$, or ≤0.25*$t_h$, or ≤0.1*$t_h$. Temperature $T_2$ is typically ≥375° C., e.g., ≥400° C., or ≥420° C., or ≥440° C., or ≥460° C., or ≥480° C., or ≥500° C. Heating time $t_h$ is typically ≥30 seconds, e.g., ≥1.0 minute, such as ≥1.5 minutes, or ≥2.0 minutes, or ≥2.5 minutes, or ≥3.0 minutes, or ≥5.0 minutes, or ≥7.5 minutes, or ≥10.0 minutes, or ≥15.0 minutes, or ≥20.0 minutes, or ≥30.0 minutes, or ≥40.0 minutes. In certain aspects, temperature $T_2$ is substantially the same as the average bed temperature of the hydroprocessing reactor, and $t_h$ is substantially the same as the average residence time of the pyrolysis tar in the hydroprocessing reactor. Doing so has been found to increase the effectiveness of the comparison of $R_T$ and $R_{Ref}$, particularly when $R_{Ref}$ is established under substantially the same hydroprocessing conditions as R. Since $R_T$ and $R_{Ref}$ are well-correlated with pyrolysis tar free radical content as measured by ESR, they can be expressed in units of "spins per gram of pyrolysis tar".

Sample preparation also includes cooling (e.g., quenching) the heated sample from $T_2$ to a temperature $T_3$, wherein $T_3 \leq T_1$. Heating rate is adjusted so that the sample decreases in temperature to substantially achieve thermal equilibrium at temperature $T_3$ at the end of a second ramp time that is $\leq t_h$, e.g., $\leq 0.75*t_h$, such as $\leq 0.5*t_h$, or $\leq 0.25*t_h$, or $\leq 0.1*t_h$.

Suitable instruments for measuring ESR include Electron Spin Resonance Spectrometer, Model JES FA 200 (available from JEOL, Japan). The ESR measurement can be carried out at any convenient temperature $\leq T_3$, e.g., ambient temperature. The ESR spectrometer can be calibrated using, e.g., 2,2-diphenyl-1-picrylhydrazyl (DPPH).

Determining $R_T$ by BN

Pyrolysis tar reactivity (and fouling tendency) also have been found to be well-correlated with the tar's aliphatic olefin content, especially the content of styrenic hydrocarbons and dienes. While not wishing to be bound by any particular theory, it is believed that aliphatic olefin compounds in the tar (i.e., the tar's aliphatic olefin components) have a tendency to polymerize during hydroprocessing, forming coke precursors that are capable of plugging or otherwise fouling the reactor. Fouling is more prevalent in the absence of hydrogenation by catalysts, such as in the preheater and dead volume zones of a hydroprocessing reactor. As a result, certain measures of the tar's aliphatic olefin content, e.g., BN, are well-correlated with tar reactivity, and $R_T$ and $R_{Ref}$ can be expressed in BN units, i.e., the amount of bromine (as $Br_2$) in grams consumed (e.g., by reaction and/or sorption) by 100 grams of a pyrolysis tar sample. BN can be used as a measure of pyrolysis tar free radical content in addition to or as an alternative to spins per gram as measured by ESR.

Bromine Index ("BI") can be used instead of or in addition to BN measurements, where BI is the amount of $Br_2$ mass in mg consumed by 100 grams of pyrolysis tar. Conventional methods for measuring BN of a heavy hydrocarbon can be used, but the invention is not limited thereto. For example, BN of a pyrolysis tar can be determined by extrapolation from conventional BN methods as applied to light hydrocarbon streams, such as electrochemical titration, e.g., as specified in A.S.T.M. D-1159; colorimetric titration, as specified in A.S.T.M. D-1158; and coulometric Karl Fischer titration. Preferably, the titration is carried out on a tar sample having a temperature ≤ ambient temperature, e.g., ≤25° C. Although the cited A.S.T.M. standards are indicated for samples of lesser boiling point, it has been found that they are also applicable to measuring pyrolysis tar BN. Suitable methods for doing so are disclosed by D. J. Ruzicka and K. Vadum in Modified Method Measures Bromine Number of Heavy Fuel Oils, Oil and Gas Journal, Aug. 3, 1987, 48-50; which is incorporated by reference herein in its entirety.

Accordingly, in certain aspects a pyrolysis tar, e.g., an SCT, is provided at a temperature in a range of about 140° C. to 350° C. A sample is withdrawn from the tar. Those skilled in the art will appreciate that the amount of tar in the sample is not critical provided the sample contains sufficient tar for carrying out the BN measurement. The sample is exposed to a predetermined temperature $T_2$ for a predetermined time $t_h$, where $T_2$ is $\geq T_1+10°$ C. The heated sample is then cooled by exposing the sample to a temperature $T_3$ that is $\leq T_1$. The cooled sample's reactivity $R_T$ is measured and the BN value is recorded. This BN value can be directly compared to an $R_{Ref}$ expressed as a BN value. As with ESR, BN is measured on a tar basis, i.e., measured on the tar sample with little or no utility fluid, e.g., less than 15 wt. % utility fluid.

Samples of the tar can be obtained after the tar is separated from the quenched effluent, for instance sampling the tar as the liquid portion of a flash drum separator, such as sampling from line 63 from separator 61 in FIG. 1. The sample is cooled to ambient temperatures or lower, and conventional measurements taken to determine aliphatic olefin contents, such as bromine number measurements, or iodine number measurements (A.S.T.M. D4607 method of WIJS Method or the Hübl method). If desired, Iodine Number can be used as an alternative to BN for establishing tar reactivity $R_T$ and reference activity $R_{Ref}$. BN may be approximated from Iodine Number by the formula:

$$BN \sim \text{Iodine Number}*(\text{Atomic Weight of } I_2)/(\text{Atomic Weight of } Br_2).$$

$R_{Ref}$ can be established by catalytically hydroprocessing a sequence of pyrolysis tar feeds in the presence of utility fluid and molecular hydrogen under Standard Hydroprocessing Conditions. Suitable methods for determining $R_{Ref}$ will now be described in more detail. The invention is not limited to these methods, and this description is not meant to foreclose the use of other methods for measuring $R_{Ref}$ within the broader scope of the invention.

Determining $R_{Ref}$

A reference reactivity $R_{Ref}$ can be established for a wide range of process conditions within the Standard Hydroprocessing Conditions. Although $R_{Ref}$ for particular process conditions (or a set of particular process conditions spanning the entire range of Standard Hydroprocessing Conditions) can be determined from modeling studies, e.g., by modeling the yield of heavy hydrocarbon deposits under selected hydroprocessing conditions, it is typically more convenient to determine $R_{Ref}$ experimentally.

One method to determine $R_{Ref}$ experimentally is by providing a set of approximately ten pyrolysis tars (or tar mixtures). Each pyrolysis tar in the set has an $R_T$ different from that of the others (ideally the $R_T$ values are substantially equally spaced), and each has an $R_T$, if measured by ESR, within the range of $1\times10^{17}$ spins per gram of tar to $1\times10^{20}$ spins per gram of tar, if measuring BN, between 15 BN to 28 BN (i.e., grams of $Br_2$/100 g sample). A table of reactivity ("R") values can be produced by hydroprocessing each pyrolysis tar in the set by hydroprocessing each tar at a plurality of selected hydroprocessing conditions within the Standard Hydroprocessing Conditions (e.g., conditions of increasing severity), and observing whether reactor fouling occurs before a pre-determined hydroprocessing time duration has elapsed. When it is desired to designate for hydroprocessing a pyrolysis tar feed that is not a member of the foregoing set under particular hydroprocessing conditions within the Standard Hydroprocessing Conditions, $R_T$ of the pyrolysis tar feed is measured, and this value of $R_T$ is compared to that R selected among the tabulated $R_{Ref}$ values which most closely corresponds to the selected hydroprocessing conditions. Hydroprocessing of the designated pyrolysis tar can be carried out efficiently with little or no reactor fouling at the selected Standard Hydroprocessing Conditions when $R_T$ is less than $R_{Ref}$, e.g., ≤75% of $R_{Ref}$, such as ≤50% of $R_{Ref}$, or ≤25% of $R_{Ref}$, or ≤10% of $R_{Ref}$.

As an example, when hydroprocessing representative pyrolysis tar under selected hydroprocessing conditions within the specified Standard Hydroprocessing Conditions, e.g. selected conditions which include an average bed temperature ≥480° C. (e.g., ≥500° C.), for an average pyrolysis tar residence time in the reactor of at least 120 seconds (e.g., at least 160 seconds), $R_{Ref}$ is typically $\leq 5\times10^{19}$ spins per gram of the pyrolysis tar. For example, $R_{Ref}$ can be $\leq 1\times10^{19}$ spins per gram of the pyrolysis tar, such as $\leq 5\times10^{18}$ spins per gram of the pyrolysis tar, or $\leq 2\times10^{18}$ spins per gram of the pyrolysis tar, or $\leq 1\times10^{18}$ spins per gram of the pyrolysis tar. $R_{Ref}$ can also be expressed in BN. Under the selected conditions, $R_{Ref}$ is typically ≤20 BN, e.g., ≤18 BN, such as ≤12 BN, or ≤10 BN, or ≤8 BN.

Comparing $R_T$ and $R_{Ref}$

In certain aspects, $R_T$ is compared with a pre-determined $R_{Ref}$ as follows. A reference reactivity $R_{Ref}$ is pre-determined, as specified for the desired hydroprocessing conditions. A pyrolysis tar sample is taken as specified, and the reactivity $R_T$ of the sample is determined (e.g., using one or more of BN, ESR, etc.). If $R_T$ is $\leq R_{Ref}$, the sampled tar (e.g., at least a portion of the tar that remains after the sample is removed) can be conducted as pyrolysis tar feed to a hydroprocessing stage for hydroprocessing under Standard Hydroprocessing Conditions in the presence of the specified utility fluid.

If $R_T$ exceeds $R_{Ref}$, the sampled tar or a portion thereof can be stored and/or further processed, e.g., by one or more of (i) conducting away the sampled tar without hydroprocessing; (ii) hydroprocessing the sampled tar under Mild Hydroprocessing Conditions in the presence of the specified utility fluid; and (iii) treating the sampled tar (e.g., by the specified blending and/or thermal treatments) to produce a treated tar.

A treated tar can be re-sampled for an $R_T$ measurement. If $R_T$ of the treated tar does not exceed $R_{Ref}$, the treated tar or a portion thereof can be conducted to the specified hydroprocessing stage for hydroprocessing under Standard Hydroprocessing Conditions in the presence of the specified utility fluid. Should $R_T$ of the treated tar still exceed $R_{Ref}$, one or more re-treatments can be carried out, e.g., one or more additional blending and/or thermal treatments, to produce a re-treated tar. The re-treated tar is then re-tested for reactivity. The specified treatments and re-treatments can be carried out until a sample of the treated (or re-treated) tar has an $R_T$ that does not exceed $R_{Ref}$ by a desired amount (e.g., $R_T \leq 25\%$ of $R_{Ref}$), or until further re-treatments are not warranted, as may be the case these would not result in an economic or processing benefit. A treated or re-treated tar (namely a pyrolysis tar composition) having an $R_T > R_{Ref}$ can be processed by one or more of (i) storing for later processing or use; (ii) conducting away without hydroprocessing; and (iii) hydroprocessing under Mild Hydroprocessing Conditions in the presence of the specified utility fluid.

Treating or Re-Treating a Pyrolysis Tar by Blending

A sampled pyrolysis tar having an $R_T > R_{Ref}$ can be treated or re-treated by blending to produce a blended tar that is suitable for use as a pyrolysis tar feed, e.g., a blended tar having an $R_T \leq R_{Ref}$. Blending can be carried out by combining the sampled tar with a sufficient amount of at least a second pyrolysis tar having an $R_T < R_{Ref}$ to achieve a blend $R_T$ that does not exceed $R_{Ref}$ by a desired amount, e.g., $R_T \leq 25\%$ of $R_{Ref}$, such as $R_T \leq 10\%$ of $R_{Ref}$. For example, one or more of $R_T$ of the first pyrolysis tar, $R_T$ of the second pyrolysis tar, and $R_T$ of the blend can each be determined by ESR.

Alternatively or in addition, BN measurements can be used to determine one or more of $R_T$ of the first pyrolysis tar, $R_T$ of the second pyrolysis tar, and $R_T$ of the blend. For example, a plurality of pyrolysis tars, including a plurality of SCTs, may be blended to produce a blended pyrolysis tar with a specific aliphatic olefin content, e.g., one exhibiting a blended sample $R_T \leq R_{Ref}$ as measured by BN. A blended tar having an $R_T \leq R_{Ref}$ can be conducted to a hydroprocessing stage as pyrolysis tar feed for hydroprocessing under Standard Hydroprocessing Conditions in the presence of the specified utility fluid. If the blended tar's $R_T$ exceeds $R_{Ref}$, it can be stored for later processing and/or use; re-treated, e.g., by the specified thermal treatment and/or additional blending; and/or hydroprocessed under Mild Hydroprocessing Conditions in the presence of the specified utility fluid.

Although it is typical to directly measure the blend's RT, this is not required, and in some aspects a calculated value of the blend's $R_T$ is used. The calculation is based on the observation that pyrolysis tar reactivity (e.g., as measured by ESR, BN, etc.) is substantially stable for typical blending time durations (e.g., in a range of about one minute to about 24 hours) at a substantially constant temperature. Accordingly, a blend's $R_T$ can be estimated from the reactivities of the first and second pyrolysis tars used to produce the blend ($R_{T1}$ and $R_{T2}$.) using the formula:

$$R_{Tblend}, \sim\{(R_{T1}*\text{grams tar 1})+(R_{T2}*\text{grams tar 2})]/(\text{grams tar 1}+\text{grams tar 2}).$$

In certain aspects, an $R_{Ref}$ is pre-determined, e.g., before a comparison with $R_T$, using one or more of the specified $R_{Ref}$ determination methods. For example, an $R_{Ref}$ substantially equal to $2\times10^{18}$ spins per gram can be established by ESR measurements for hydroprocessing carried out under Standard Hydroprocessing Conditions including a temperature ≥480° C. and a residence time ≥120 seconds. A first SCT (SCT1) is evaluated for suitability as pyrolysis tar feed by measuring $R_T$ using one or more of the specified $R_T$ determination methods, e.g., ESR and/or BN. If $R_T$ of SCT1 is $\leq R_{Ref}$, no alteration or blending of SCT1 is indicated before hydroprocessing. If however $R_T$ of SCT1 is $> R_{Ref}$, fouling potential is lessened by blending SCT1 with a second SCT (SCT2), where $R_T$ of SCT2 is $< R_{Ref}$. For instance, if $R_T$ of SCT1 is about $1\times10^{19}$ spins per gram, and $R_T$ of SCT2 is about $5\times10^{17}$ spins per gram, then a blend of 100 grams of SCT1 with about 500 grams of SCT2. (e.g., using a blend ratio of (wt. % SCT2 in blend/wt. % SCT1 in blend) ~0.83.6/16.6, or ~5.0) is estimated to produce a blended SCT with an estimated $R_T$ for the blend of about $2\times10^{18}$ spins/gram. As another example, if $R_T$ of SCT1 is about 30 (BN), and $R_T$ of SCT2 is about 24 (BN), then a blend of 200 grams of SCT1 with about 200 grams of SCT2. (e.g., using a blend ratio of (wt. % SCT2 in blend/wt. % SCT1 in blend) is estimated to produce a blended SCT having an $R_T$ for the blend of about 27 BN.

If a blended sample's reactivity $R_T$ is still greater than $R_{Ref}$, then (i) the blend ratio may be increased to produce a re-blended tar having a lesser $R_T$ and/or (ii) one or more additional pyrolysis tars having an $R_T$ that is less than or equal to that of SCT2 can be added to the blend. $R_T$ of the re-blended tar can be measured using any of the specified methods for measuring $R_T$.

Blending of pyrolysis tar can cause precipitation or particulates, particularly when the pyrolysis tar has an $I_N > 110$.

Precipitation of particulates (e.g., asphaltenes) during and after blending is lessened when the first pyrolysis tar (which may itself be a mixture of pyrolysis tars) has an $S_{BN}$>135 and an $I_N$>80 and the $S_{BN}$ of the blended tar composition is at least 20 solvency units greater than the second pyrolysis tar's (and/or the blended pyrolysis tar's) $I_N$. For example, it can be desirable to carry out blending such that (i) the first pyrolysis tar has an $S_{BN}$>135 and an $I_N$>80, (ii) the second pyrolysis tar has an $S_{BN}$ that is less than that of the first pyrolysis tar, (iii) the blended tar composition has an $S_{BN}$ that is less than that of the first pyrolysis tar, (iv) the second pyrolysis tar (and/or the blend) has an $I_N$ that is less than that of the first pyrolysis tar, and (v) the $S_{BN}$ of the blended tar composition is at least 20 solvency units greater than the second pyrolysis tar's $I_N$, or more preferred, at least 30 solvency units, or most preferred, at least 40 solvency units greater than the second pyrolysis tar's $I_N$. Optionally, the second tar's (or any additional tar's) $I_N$ is less than the $S_{BN}$ of the final pyrolysis tar blend. Parameters $S_{BN}$ and $I_N$ can be determined using the methods disclosed in U.S. Pat. No. 5,871,634.

Treating or Re-Treating a Pyrolysis Tar by Thermal Treatment

As an alternative or in addition to blending, a sampled tar's $R_T$ can be decreased (e.g., improved) by one or more thermal treatments. Conventional thermal treatments are suitable, including heat soaking, but the invention is not limited thereto. One or more of such thermal treatments can be used instead of or in addition to blending of the sampled tar with additional pyrolysis tar. It is believed that the specified thermal treatment is particularly effective for decreasing the tar's aliphatic olefin content.

One representative pyrolysis tar is an SCT having an $R_T$>$R_{Ref}$ (e.g., an $R_T$≥28 BN), a density at 15° C. that is ≥1.10 g/cm$^3$, a 50° C. viscosity in the range of ≥1.0×10$^4$ cSt, an $I_N$>80, wherein ≥70 wt. % of the pyrolysis tar's hydrocarbon have an atmospheric boiling point of ≥290° C. This pyrolysis tar can be provided, e.g., as a tar stream entering a tar drum located downstream of steam cracker effluent quenching. When this SCT is provided at a temperature $T_1$ in the range of about 140° C. to 350° C., the thermal treatment can include heating the SCT to a temperature $T_{HS}$ that is at least 10° C. greater than $T_1$, e.g., at least 20° C. greater than $T_1$, such as 30° C. greater than $T_1$. The heating can be carried out in a lower section of the tar drum, e.g., by introducing steam (which also desirably strips from the tar any lighter hydrocarbon as may be present). The heated SCT is then maintained within a temperature range that is ≥$T_{HS}$ and ≤360° C. for a time $T_{HS}$ in the range of from 1 minute to 400 minutes. In certain aspects, the thermal treatment conditions include (i) $T_{HS}$ is at least 10° C. greater than $T_1$ and (ii) $T_{HS}$ is in the range of 300° C. to 360° C. Typical $T_{HS}$ and $t_{HS}$ ranges include 180° C.≤$T_{HS}$<320° C. and 5 minutes ≤$T_{HS}$≤100 minutes; e.g., 200° C.≤$T_{HS}$≤280° C. and 5 minute ≤$T_{HS}$≤30 minutes. The specified thermal treatment is effective for decreasing the representative SCT's $R_T$ into a range of $R_T$≤0.9*$R_{Ref}$, such as an $R_T$≤0.75*$R_{Ref}$, or an $R_T$≤0.5*$R_{Ref}$, or e.g., $R_T$≤0.1*$R_{Ref}$. For example, thermally treating a representative pyrolysis tar having an $R_T$≥28 BN as specified has been found to produce a treated tar having an $R_T$ that is typically ≤20 BN, e.g., ≤18 BN, such as ≤12 BN, or ≤10 BN, or ≤8 BN.

When the thermal treatment includes heat soaking, the heat soaking can be carried out at least in part in one or more soaker drums and/or in vessels, conduits, and other equipment (e.g. flash drums, knock out drums, fractionators, water-quench towers, indirect condensers) associated with, e.g., (i) separating the pyrolysis tar from the pyrolysis effluent and/or (ii) conveying the pyrolysis tar to hydroprocessing. The location of the thermal treatment is not critical. The thermal treatment can be carried out at any convenient location, e.g., after tar separation from the pyrolysis effluent and before hydroprocessing, such as downstream of a tar drum and upstream of mixing the thermally treated tar with utility fluid.

In certain aspects, the pyrolysis tar subjected to thermal treatment comprises SCT or a blend comprising SCT. At least part of the thermal treatment can be carried out in one or more tar drums and/or a steam cracker primary fractionator, e.g., by regulating a bottoms pump-around loop in the drum and/or fractionator to achieve the specified thermal treatment conditions. For instance, in the processing illustrated schematically in FIG. 1, pyrolysis tar in conduit 63 is piped via line 65 to for mixing with a utility fluid supplied via line 310. Piping 65 can be insulated to maintain the temperature of pyrolysis tar within the desired temperature range for the desired residence time prior mixing with the utility fluid from line 10.

Alternatively or in addition, other process equipment (existing or added) can be used for the thermal treatment, such as one or more heat exchangers for heating the tar to achieve the specified $T_{HS}$ for the specified $t_{HS}$. More than one heat exchanger can be used: a first heat exchanger may be positioned before or after pump 64 for an indirect transfer of heat to the SCT, with a second heat exchanger positioned at a location along line 65. The first heat exchanger operates by indirectly transferring heat to the tar from a first working fluid which enters the first heat exchanger at a temperature greater than that at which the tar enters. The second heat exchanger removes heat from the heated tar in order to decrease the tar's temperature to below 150° C. (which substantially halts heat soaking) after the desired tHs has been achieved. The second heat exchanger operates by transferring heat from the heated tar to a second working fluid, which enters the second heat exchanger at a temperature less than that at which the heated tar enters. For instance, it may be desired to heat soak an SCT stream that is removed form a separation drum, the removed tar having a temperature $T_1$ in the range of 240° C. to 290° C. A first heat exchanger can be located along conduit 65 to increase the SCT's temperature to the desired heat soak temperature $T_{HS}$ for the desired heat soak time $t_{HS}$. For example, $T_{HS}$ can be at least 10° C. greater than $T_1$ and less than 360° C., e.g., in the range of about 250° C. (when $T_1$ is 240° C.) to 360° C., such as 275° C. to 325° C. (when 265° C.≤$T_1$≤315° C.). The heat soak time $t_{HS}$ can be, e.g., ≥10 minutes, such as in the range of from 10 minutes to 30 minutes. Typically, the tar is heated in the first heat exchanger to a temperature that typically is slightly greater (e.g., about 10° C. greater) than the desired $T_{HS}$ to allow for heat losses in conduit 65 during transit. In aspects where (i) the desired $t_{HS}$ is in the range of from 15 minutes to 25 minutes and (ii) the heated tar's residence time in conduit 65 exceeds 25 minutes, a second heat exchanger may be located along conduit 65 that is about 25 minutes' downstream of the first heat exchanger, where the second heat exchanger cools the heated tar to a temperature of 150° C. or less. In aspects exhibiting a substantially constant tar flow rate, the heat exchangers can be adjusted to produce an SCT temperature substantially equal to the desired $T_{HS}$ at a location along conduit 65 that is about midway between the first and second exchangers.

The comparison of $R_{Ref}$ with a treated or re-treated tar's $R_T$ can be carried out in substantially the same way as described for the sampled tar. Options available for processing the treated or re-treated tar based on the results of the comparison of $R_T$ and $R_{Ref}$ are substantially the same as those available for the sampled tar. In other words, if the treated or re-treated tar's $R_T$ exceeds $R_{Ref}$, it can be one or more of (i) stored for later processing and/or use; (ii) subjected to additional treatments, e.g., by additional thermal treatment and/or additional blending; and (iii) hydroprocessing under Mild Hydroprocessing Conditions in the presence of the specified utility fluid. A treated or re-treated tar having an $R_T \leq R_{Ref}$ can be conducted to a hydroprocessing stage as pyrolysis tar feed for hydroprocessing under Standard Hydroprocessing Conditions in the presence of the specified utility fluid. A further decrease in fouling potential can be obtained by carrying out the treating to achieve an $R_T$ of the treated tar that is equal to $R_{Ref}$, e.g., by further increasing the blend ratio. For example, treating or re-treating (such as additional blending and/or additional heat soaking) can be used to achieve an $R_T \leq 0.9*R_{Ref}$, such as an $R_T \leq 0.75*R_{Ref}$, or an $R_T \leq 0.5*R_{Ref}$, or e.g., $R_T \leq 0.1*R_{Ref}$, or $R_T \leq 18$ BN, e.g., ≤12 BN, such as ≤10 BN, or ≤8 BN.

The pyrolysis tar feed typically comprises ≥50 wt. % of pyrolysis tar, such as SCT, e.g., ≥75 wt. %, such as ≥90 wt. %. In certain aspects, the pyrolysis tar feed is substantially all pyrolysis tar. At least part of the hydroprocessing of the pyrolysis tar feed is carried out in the presence of a utility fluid. Certain forms of utility fluid will now be described in more detail. The invention is not limited to these forms, and this description is not meant to foreclose using other utility fluids within the broader scope of the invention.

Utility Fluids

Depending on processing options indicated by the outcome of the $R_T$ vs. $R_{Ref}$ comparison, a pyrolysis tar feed may be hydroprocessed in one or more hydroprocessor stages. At least one stage of the hydroprocessing is carried out in the presence of a utility fluid comprising a mixture of multi-ring compounds. The rings can be aromatic or non-aromatic, and can contain a variety of substituents and/or heteroatoms. For example, the utility fluid can contain ring compounds in an amount ≥40.0 wt. %, ≥45.0 wt. %, ≥50.0 wt. %, ≥55.0 wt. %, or ≥60.0 wt. %., based on the weight of the utility fluid. In certain aspects, at least a portion of the utility fluid is obtained from the hydroprocessor effluent, e.g., by one or more separations. This can be carried out as disclosed in U.S. Pat. No. 9,090,836, which is incorporated by reference herein in its entirety.

Typically, the utility fluid comprises aromatic hydrocarbon, e.g., ≥25.0 wt. %, such as ≥40.0 wt. %, or ≥50.0 wt. %, or ≥55.0 wt. %, or ≥60.0 wt. % of aromatic hydrocarbon, based on the weight of the utility fluid. The aromatic hydrocarbon can include, e.g., one, two, and three ring aromatic hydrocarbon compounds. For example, the utility fluid can comprise ≥15 wt. % of 2-ring and/or 3-ring aromatics, based on the weight of the utility fluid, such as ≥20 wt. %, or ≥25.0 wt. %, or ≥40.0 wt. %, or ≥50.0 wt. %, or ≥55.0 wt. %, or ≥60.0 wt. %. Utilizing a utility fluid comprising aromatic hydrocarbon compounds having 2-rings and/or 3-rings is advantageous because utility fluids containing these compounds typically exhibit an appreciable $S_{BN}$.

The utility fluid typically has an A.S.T.M. D86 10% distillation point ≥60° C. and a 90% distillation point ≤425° C., e.g., ≤400° C. In certain aspects, the utility fluid has a true boiling point distribution with an initial boiling point ≥130° C. (266° F.) and a final boiling point ≤566° C. (1050° F.). In other aspects, the utility fluid has a true boiling point distribution with an initial boiling point ≥150° C. (300° F.) and a final boiling point ≤430° C. (806° F.). In still other aspects, the utility has a true boiling point distribution with an initial boiling point ≥177° C. (350° F.) and a final boiling point ≤425° C. (797° F.). True boiling point distributions (the distribution at atmospheric pressure) can be determined, e.g., by conventional methods such as the method of A.S.T.M. D7500. When the final boiling point is greater than that specified in the standard, the true boiling point distribution can be determined by extrapolation. A particular form of the utility fluid has a true boiling point distribution having an initial boiling point ≥130° C. and a final boiling point ≤566° C.; and/or comprises ≥15 wt. % of two ring and/or three ring aromatic compounds.

The amounts of utility fluid and pyrolysis tar feed employed during hydroprocessing are generally in the range of from about 20.0 wt. % to about 95.0 wt. % of the pyrolysis tar feed and from about 5.0 wt. % to about 80.0 wt. % of the utility fluid, based on total weight of utility fluid plus pyrolysis tar feed. For example, the relative amounts of utility fluid and pyrolysis tar feed during hydroprocessing can be in the range of (i) about 20.0 wt. % to about 90.0 wt. % of the pyrolysis tar feed and about 10.0 wt. % to about 80.0 wt. % of the utility fluid, or (ii) from about 40.0 wt. % to about 90.0 wt. % of the pyrolysis tar feed and from about 10.0 wt. % to about 60.0 wt. % of the utility fluid. The utility fluid: pyrolysis tar feed weight ratio is typically ≥0.01, e.g., in the range of 0.05 to 4.0, such as in the range of 0.1 to 3.0, or 0.3 to 1.1. At least a portion of the utility fluid can be combined with at least a portion of the pyrolysis tar feed during the hydroprocessing, e.g., within a hydroprocessing zone, but this is not required. In certain aspects, at least a portion of the utility fluid and at least a portion of the pyrolysis tar feed are supplied as separate streams and combined into one feed stream (the "hydroprocessor feed") prior to entering (e.g., upstream of) the hydroprocessing stage(s). For example, the pyrolysis tar feed and utility fluid can be combined to produce a hydroprocessor feed upstream of the hydroprocessing stage, the hydroprocessor feed comprising, e.g., (i) about 20.0 wt. % to about 90.0 wt. % of the pyrolysis tar feed and about 10.0 wt. % to about 80.0 wt. % of the utility fluid, or (ii) from about 40.0 wt. % to about 90.0 wt. % of the pyrolysis tar feed and from about 10.0 wt. % to about 60.0 wt. % of the utility fluid, the weight percents being based on the weight of the hydroprocessor feed.

In certain aspects, the pyrolysis tar feed is combined with a utility fluid to produce a hydroprocessor feed. Typically these aspects feature one or more of (i) a utility fluid having an $S_{BN}>100$, e.g., $S_{BN}\geq 110$; a pyrolysis tar feed having an $I_N>70$, e.g., >80; and (iii) >70 wt. % of the pyrolysis tar feed resides in compositions having an atmospheric boiling point ≥290° C. The hydroprocessor feed can have, e.g., an $S_{BN}\geq 110$, such as ≥120, or ≥130. It has been found that there is a beneficial decrease in reactor plugging when hydroprocessing pyrolysis tars an $I_N>110$ provided that, after being combined with the utility fluid, the hydroprocessor feed has an $S_{BN}\geq 150$, ≥155, or ≥160. The pyrolysis tar (or mixture of pyrolysis tars) can have a relatively large insolubility number, e.g., $I_N>80$, especially >100, or >110, provided the utility fluid has relatively large $S_{BN}$, e.g., $S_{BN}\geq 100$, ≥120, or ≥140.

Certain aspects of the invention will now be described in which a pyrolysis tar feed is hydroprocessed under the specified hydroprocessing conditions (Standard Hydroprocessing Conditions or Mild Hydroprocessing Conditions, as the case may be) to produce a hydroprocessed pyrolysis tar. The invention is not limited to these aspects, and this description is not meant to foreclose other aspects within the broader scope of the invention.

Hydroprocessing

The pyrolysis tar feed is typically combined with utility fluid to produce a hydroprocessor feed before hydroprocessing. The hydroprocessor feed is hydroprocessed in the presence of a treatment gas comprising molecular hydrogen, and generally in the presence of at least one catalyst. The hydroprocessing produces a hydroprocessed pyrolysis tar product (the hydroprocessed pyrolysis tar) that typically exhibits one or more of a decreased viscosity, decreased atmospheric boiling point range, and increased hydrogen content over that of the pyrolysis tar feed. These features lead in turn to improved compatibility of the tar with other heavy oil blendstocks, and improved utility as a fuel oil and blend-stock.

Depending on processing options indicated by the comparison of $R_{Ref}$ and the pyrolysis tar feed's $R_T$, the hydroprocessing is carried out under Standard Hydroprocessing Conditions or Mild Hydroprocessing Conditions. The name by which the hydroprocessing is identified is not critical. For example, the hydroprocessing can be characterized as or more of hydrocracking (including selective hydrocracking), hydrogenation, hydrotreating, hydrodesulfurization, hydrodenitrogenation, hydrodemetallation, hydrodearomatization, hydroisomerization, or hydrodewaxing. The hydroprocessing can be carried out in at least one vessel or zone that is located, e.g., within a hydroprocessing stage downstream of the pyrolysis stage and the stage or stages within which the hydroprocessed tar is recovered. Typically, the hydroprocessing temperatures in a hydroprocessing zone is the average temperature of the hydroprocessing reactor's catalyst bed (one half the difference between the bed's inlet and outlet temperature). When the hydroproces sing reactor contains more than one hydroprocessing zone and/or more than one catalyst bed (e.g., as shown in FIG. 1) the hydroprocessing temperature is the average temperature in the hydroprocessing reactor, e.g., (one half the difference between the temperature of the most upstream catalyst bed's inlet and the temperature of the most downstream catalyst bed's outlet temperature).

Hydroprocessing is carried out in the presence of hydrogen, e.g., by (i) combining molecular hydrogen with the pyrolysis tar feed and/or utility fluid upstream of the hydroprocessing, and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. The treat gas optionally contains ≥about 50 vol. % of molecular hydrogen, e.g., ≥about 75 vol. %, based on the total volume of treat gas conducted to the hydroproces sing stage.

The pyrolysis tar feed can be upgraded before it is combined with the utility fluid to produce the hydroprocessor feed. For example, FIG. 1 schematically shows a pyrolysis tar feed introduced via conduit 61 to separation stage 62 for separation of one or more light gases and/or particulates from the pyrolysis tar feed. An upgraded pyrolysis tar feed is collected in conduit 63 and transferred by pump 64 through conduit 65. The upgraded pyrolysis tar feed is combined with a utility fluid supplied via line 310 to produce the hydroprocessor feed, which is conducted to a first pre-heater 70 via conduit 320. Optionally, a supplemental utility fluid, may be added via conduit 330. The hydroprocessor feed (which typically is primarily in liquid phase) is conducted to a supplemental pre-heat stage 90 via conduit 370. The supplemental pre-heat stage 90 can be, e.g., a fired heater. Recycled treat gas, comprising molecular hydrogen, is obtained from conduit 265 and, if necessary, is mixed with fresh treat gas, supplied through conduit 131. The treat gas is conducted via conduit 60 to a second pre-heater 360, before being conducted to the supplemental pre-heat stage 90 via conduit 80. Fouling in reactor 110 can be decreased by increasing pyrolysis tar pre-heater duty in preheaters 70 and 90. It has surprisingly been found that when $R_T$ is $\leq R_{Ref}$ that pyrolysis tar pre-heater duty can be decreased. Even more surprisingly, it has been found that for a pyrolysis tar having an $R_T \leq 18$ BN, e.g., ≤12 BN, such as ≤10 BN, or ≤8 BN (as can be achieved by one or more of the specified treatments, e.g., one or more of the specified blendings or thermal treatments), that it is not necessary to carry out a mild hydroprocessing of the treated tar before hydroprocessing under Standard Hydroprocessing Conditions. Beneficially, this is the case even for a pyrolysis tar having an initial $R_T$ (before treatment) that is >28.

The pre-heated hydroprocessor feed (from line 380) is combined with the pre-heated treat gas (from line 390) and then conducted via line 100 to a hydroprocessing reactor 110. Mixing means can be utilized for combining the pre-heated hydroprocessor feed with the pre-heated treat gas in hydroprocessing reactor 110, e.g., one or more gas-liquid distributors of the type conventionally utilized in fixed bed reactors. The hydroprocessing is carried out in the presence of a catalytically effective amount of at least one hydroprocessing catalyst located in at least one catalyst bed 115. Additional catalyst beds, e.g., 116, 117, etc., may be connected in series with the catalyst bed 115 with optional intercooling quench using treat gas from conduit 60 being provided between beds (not shown).

A hydroprocessor effluent is conducted away from hydroprocessing reactor 110 via conduit 120. When the second and third preheaters (360 and 70) are heat exchangers, the hot hydroprocessing effluent in conduit 120 can be used to preheat the tar/utility fluid and the treat gas respectively by indirect heat transfer. Following this optional heat exchange, the hydroprocessor effluent is conducted to separation stage 130 for separating total vapor product (e.g., heteroatom vapor, vapor-phase cracked products, unused treat gas, etc.) and total liquid product ("TLP") from the hydroprocessed effluent. The total vapor product is conducted via line 200 to upgrading stage 220, which comprises, e.g., one or more amine towers. Fresh amine is conducted to stage 220 via line 230, with rich amine conducted away via line 240. Unused treat gas is conducted away from stage 220 via line 250, compressed in compressor 260, and conducted via lines 265, 60, and 80 for re-cycle and re-use in the hydroprocessing stage 110.

The TLP from separation stage 130 typically comprises hydroprocessed pyrolysis tar, e.g., ≥10 wt. % of hydroprocessed pyrolysis tar, such as ≥50 wt. %, or ≥75 wt. %, or ≥90 wt. %. The TLP optionally contains non-tar components, e.g., hydrocarbon having a true boiling point range that is substantially the same as that of the utility fluid (e.g., unreacted utility fluid). The TLP, which is an upgraded tar product, is useful as a diluent (e.g., a flux) for heavy hydrocarbons, especially those of relatively high viscosity. Optionally, all or a portion of the TLP can substitute for more expensive, conventional diluents. Non-limiting examples of heavy, high-viscosity streams suitable for blending with the bottoms include one or more of bunker fuel, burner oil, heavy fuel oil (e.g., No. 5 or No. 6 fuel oil), high-sulfur fuel oil, low-sulfur fuel oil, regular-sulfur fuel oil (RSFO), and the like.

In the aspects illustrated in FIG. 1, TLP from separation stage 130 is conducted via line 270 to a further separation stage 280, e.g., for separating from the TLP one or more of hydroprocessed pyrolysis tar, additional vapor, and at last one stream suitable for use as recycle as utility fluid or a utility fluid component. Separation stage 280 may be, for example, a distillation column with side-stream draw although other conventional separation methods may be utilized. The TLP is separated in further separation stage 280 into an overhead stream, a side stream and a bottoms stream, listed in order of increasing boiling point. The overhead stream (e.g., vapor) is conducted away from separation stage 280 via line 290. The bottoms stream (typically comprising a major amount of the hydroprocessed pyrolysis tar) is conducted away via line 134. At least a portion of the overhead and bottoms streams may be conducted away, e.g., for storage and/or for further processing. The bottoms portion of the TLP can be desirable as a diluent (e.g., a flux) for heavy hydrocarbon, e.g., heavy fuel oil. In certain aspects, at least a portion of the overhead stream 290 is combined with at least a portion of the bottoms stream 134 to form an upgraded tar product (not shown).

Optionally, the operation of separation stage 280 is adjusted to shift the boiling point distribution of side stream 340 so that side stream 340 has properties desired for the utility fluid, e.g., (i) a true boiling point distribution having an initial boiling point ≥177° C. (350° F.) and a final boiling point ≤566° C. (1050° F.) and/or (ii) an $S_{BN}$ 100, e.g., ≥120, such as ≥125, or ≥130. Optionally, trim molecules may be separated, for example, in a fractionator (not shown), from separation stage 280 bottoms or overhead or both and added to the side stream 340 as desired. The side stream is conducted away from separation stage 280 via conduit 340. At least a portion of the side stream 340 can be utilized as utility fluid and conducted via pump 300 and conduit 310. Typically, the side stream composition of line 310 is at least 10 wt. % of the utility fluid, e.g., ≥25 wt. %, such as ≥50 wt. %.

Conventional hydroprocessing catalysts can be utilized for hydroprocessing the pyrolysis tar stream in the presence of the utility fluid, such as those specified for use in resid and/or heavy oil hydroprocessing, but the invention is not limited thereto. Suitable hydroprocessing catalysts include bulk metallic catalysts and supported catalysts. The metals can be in elemental form or in the form of a compound. Typically, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof. Suitable conventional catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pre-treat catalyst, such as DN3651 and/or DN3551, available from the same source.

In certain aspects, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In particular aspects, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

Hydroprocessing is carried out under Standard or Mild Hydroprocessing Conditions depending on processing options indicated by the comparison of $R_T$ and $R_{Ref}$. These conditions will now be described in more detail.

Standard Hydroprocessing Conditions

Standard Hydroprocessing Conditions include a temperature ≥200° C., a pressure ≥8 MPa, and a weight hourly space velocity ("WHSV") of the pyrolysis tar feed that is ≥0.3 $hr^{-1}$. Optionally, the Standard Hydroprocessing Conditions include a temperature >400° C., e.g., in the range of from 300° C. to 500° C., such as 350° C. to 430° C., or 350° C. to 420° C., or 360° C. to 420° C.; and a WHSV in the range of from 0.3 $hr^{-1}$ to 20 $hr^{-1}$ or 0.3 $hr^{-1}$ to 10 $hr^{-1}$. Typically, Standard Hydroprocessing Conditions include a molecular hydrogen partial pressure during the hydroprocessing that is generally ≥8 MPa, such ≥9 MPa, or ≥10 MPa, although in certain aspects it is ≤14 MPa, such as ≤13 MPa, or ≤12 MPa. WHSV of the pyrolysis tar feed is optionally ≥0.5 $hr^{-1}$, e.g., in the range of from 0.5 $hr^{-1}$ to 20 $hr^{-1}$, such as 0.5 $hr^{-1}$ to 10 $hr^{-1}$. WHSV of the hydroprocessor feed (the pyrolysis tar feed combined with utility fluid) is typically ≥0.5 $hr^{-1}$, such as ≥1.0 $hr^{-1}$, although in certain aspects it is ≤5 $hr^{-1}$, such as ≤4 $hr^{-1}$, for example ≤3 $hr^{-1}$.

The amount of molecular hydrogen supplied to a hydroprocessing stage operating under Standard Hydroprocessing Conditions is typically in the range of from about 1000 SCF/B (standard cubic feet per barrel) (178 S $m^3/m^3$) to 10000 SCF/B (1780 S $m^3/m^3$), in which B refers to barrel of hydroprocessor feed to the hydroprocessing stage (the pyrolysis tar feed combined with the utility fluid). For example, the molecular hydrogen can be provided in a range of from 3000 SCF/B (534 S $m^3/m^3$) to 6000 SCF/B (1068 S $m^3/m^3$). In another aspect, the rate can be 270 (S $m^3/m^3$) of molecular hydrogen per cubic meter of the pyrolysis tar feed to 534 S $m^3/m^3$. The amount of molecular hydrogen supplied to hydroprocess the pyrolysis tar feed is typically less than would be the case if the pyrolysis tar feed contained greater amounts of aliphatic olefin, e.g., $C_{6+}$ olefin, such as vinyl aromatics. The molecular hydrogen consumption rate during Standard Hydroprocessing Conditions is typically in the range of about 270 standard cubic meters/cubic meter (S $m^3/m^3$) to about 534 S $m^3/m^3$ (1520 SCF/B to 3000 SCF/B, where the denominator represents barrels of the pyrolysis tar feed, e.g., barrels of SCT in a hydroprocessor feed, e.g., in the range of about 280 to about 430 S $m^3/m^3$, such as about 290 to about 420 S $m^3/m^3$, or about 300 to about 410 S $m^3/m^3$. The indicated molecular hydrogen consumption rate is typical for a pyrolysis tar feed containing ≤5 wt. % of sulfur, e.g., ≤5 wt. %, such as ≤1 wt. %, or ≤0.5 wt. %. A greater amount of molecular hydrogen is typically consumed when the pyrolysis tar feed contains a greater sulfur amount.

Within the parameter ranges (T, P, WHSV, etc.) specified for Standard Hydroprocessing Conditions, particular hydroprocessing conditions for a particular pyrolysis tar feed are typically selected to (i) achieve the desired 566° C.+ conversion, typically ≥20 wt. % substantially continuously for at least ten days, and (ii) produce a TLP and hydroprocessed pyrolysis tar having the desired properties, e.g., the desired density and viscosity. The term 566° C.+ conversion means the conversion during hydroprocessing of pyrolysis tar compounds having boiling a normal boiling point ≥566° C. to compounds having boiling points <566° C. This 566° C.+ conversion includes a high rate of conversion of THs, resulting in a processed pyrolysis tar having desirable properties.

Respecting the properties of TLP and hydroprocessed pyrolysis tar, the density measured at 15° C. of the TLP, and particularly the hydroprocessed pyrolysis tar, is typically at least 0.10 g/cm$^3$ less than the density of the pyrolysis tar feed in conduit 61 of FIG. 1). For example, the density of the TLP and/or the hydroprocessed pyrolysis tar can be at least 0.12, preferably, at least 0.14, 0.15, or 0.17 g/cm$^3$ less than the density of the pyrolysis tar feed. The viscosity measured at 50° C. of the TLP (and/or the hydroprocessed pyrolysis tar) is typically <200 cSt. For example, the viscosity can be <150 cSt, such as <100 cSt, or <75 cSt, or <50 cSt, or <40 cSt, or <30 cSt. Generally, hydroprocessing under Standard Hydroprocessing Conditions results in a significant viscosity improvement over the pyrolysis tar feed. For example, when the viscosity of the raw pyrolysis tar measured at 50° C. is ≥1.0×10$^4$ cSt, e.g., ≥1.0×10$^5$ cSt, ≥1.0×10$^6$ cSt, or ≥1.0×10$^7$ cSt, the viscosity of the TLP and/or hydroprocessed tar measured at 50° C. is typically <200 cSt, e.g., <150 cSt, preferably, <100 cSt, <75 cSt, <50 cSt, <40 cSt, or <30 cSt.

For a pyrolysis tar feed having an $R_T \leq R_{Ref}$, particularly $2*R_T \leq R_{Ref}$, more particularly $5*R_T \leq R_{Ref}$, and even more particularly $10*R_T \leq R_{Ref}$, the hydroprocessing can be carried out under Standard Hydroprocessing Conditions for a significantly longer duration without significant reactor fouling (e.g., as evidenced by no significant increase in hydroprocessing reactor pressure drop during the desired duration of hydroprocessing, such as a pressure drop of ≤140 kPa during a hydroprocessing duration of 10 days, typically ≤70 kPa, or ≤35 kPa) than is the case under substantially the same hydroprocessing conditions for a pyrolysis tar feed having an $R_T > R_{Ref}$. When $2*R_T \leq R_{Ref}$, the duration of hydroprocessing without signifantly fouling is typically least 10 times longer than would be the case for a pyrolysis tar feed having an $R_T > R_{Ref}$, e.g., ≥100 times longer, such as ≥1000 times longer. In other words, decreasing $R_T$ to a factor of two below $R_{Ref}$ typically increases the duration of hydroprocessing by at least a factor of ten over the duration achieved at $R_T = R_{Ref}$.

Processing option available for pyrolysis tar having an $R_T > R_{Ref}$ include hydroprocessing under Mild Hydroprocessing Conditions, which will now be described in more detail. Although hydroprocessing under Mild Hydroprocessing Conditions can be used when the pyrolysis tar has an $R_T \leq R_{Ref}$, the resulting hydroprocessed pyrolysis tar typically has properties that are not as desirable as those achieved when Standard Hydroprocessing Conditions are used.

Mild Hydroprocessing Conditions

Mild Hydroprocessing Conditions expose the pyrolysis tar feed to less severe conditions that is the case when Standard Hydroprocessing Conditions are used. For example, Compared to Standard Hydroprocessing Conditions, Mild Hydroprocessing Conditions utilize one or more of a lesser hydroprocessing temperature, a lesser hydroprocessing pressure, a greater hydroprocessor feed WHSV, a greater pyrolysis tar feed WHSV, and a lesser molecular hydrogen consumption rate. Within the parameter ranges (T, P, WHSV, etc.) specified for Mild Hydroprocessing Conditions, particular hydroprocessing conditions for a particular pyrolysis tar feed are typically selected for a desired 566° C.+ conversion, typically in the range of from 0.5 wt. % to 5 wt. % substantially continuously for at least ten days.

For a pyrolysis tar feed having an $R_T$ that is substantially equal to $R_{Ref}$, the least severe conditions within the Standard Hydroprocessing Conditions which achieve a 566° C.+ conversion, of ≥20 wt. % substantially continuously for at least ten days are identified as hydroprocessing temperature $T_S$, hydroprocessing pressure $P_S$, pyrolysis tar feed space velocity $WHSV_S$, and molecular hydrogen consumption ("$C_S$"). Mild Hydroprocessing Conditions include a temperature hydroprocessing temperature $T_M \geq 150°$ C. , e.g., ≥200° C. but less than $T_S$ (e.g., $T_M \leq T_S - 10°$ C., such as ≤400° C.), a pressure $P_M$ that is ≥8 MPa but less than $P_S$, a pyrolysis tar feed $WHSV_M$ that is ≥0.3 hr$^{-1}$ and greater than $WHSV_S$, and a molecular hydrogen consumption rate ("$C_M$") that in the range of from 150 standard cubic meters of molecular hydrogen per cubic meter of the pyrolysis tar feed (S m$^3$/m$^3$) to about 400 S m$^3$/m$^3$ (845 SCF/B to 2250 SCF/B) but less than $C_S$.

Typically, $WHSV_M$ is $>WHSV_S+0.01$, e.g., $\geq WHSV_S+0.05$ hr$^{-1}$, such as $\geq WHSV_S+0.1$ hr$^{-1}$, or $\geq WHSV_S+0.5$ hr$^{-1}$, or $\geq WHSV_S+1$ hr$^{-1}$, or $\geq WHSV_S+10$ hr$^{-1}$, or more. Typically, Mild Hydroprocessing Conditions utilize a lesser temperature (e.g., average bed temperature) than does Standard hydroprocessing, such as $T_M \leq T_S - 25°$ C., such as $T_M \leq T_S - 50°$ C. For example, $T_M$ can be ≤440° C.

The higher the $R_T$ measurement is above $R_{Ref}$, the greater the tendency for the pyrolysis tar to foul, and the greater need to employ the specified blending, the specified Mild Hydroprocessing Conditions, or to closely examine other characteristics of the hydroprocessing which may benefit from modification. Although the foregoing Mild Hydroprocessing Conditions are effective, the invention is not limited thereto. When $R_T$ exceeds $R_{Ref}$, any hydroprocessing conditions that are effective for reducing fouling may be used. For instance, the speed of the reaction may be decreased by further decreasing the amount of molecular hydrogen provided to the hydroprocessing, or increasing the weight hourly space velocity, or reducing hydroprocessing pressure and/or temperature beyond that specified for Mild Hydroprocessing Conditions.

For a pyrolysis tar feed having an $R_T > R_{Ref}$, the hydroprocessing can be carried out under Mild Hydroprocessing Conditions for a significantly longer duration without significant reactor fouling (e.g., as evidenced by no significant increase in hydroprocessing reactor pressure drop) than is the case when hydroprocessing a substantially similar pyrolysis tar feed under Standard Hydroprocessing Conditions. The duration of hydroprocessing without signifantly fouling is typically at least 10 times longer than would be the case when hydroprocessing a pyrolysis tar feed having an $R_T > R_{Ref}$ under Standard Hydroprocessing Conditions, e.g., ≥100 times longer, such as ≥1000 times longer.

Examples

Figure 2:
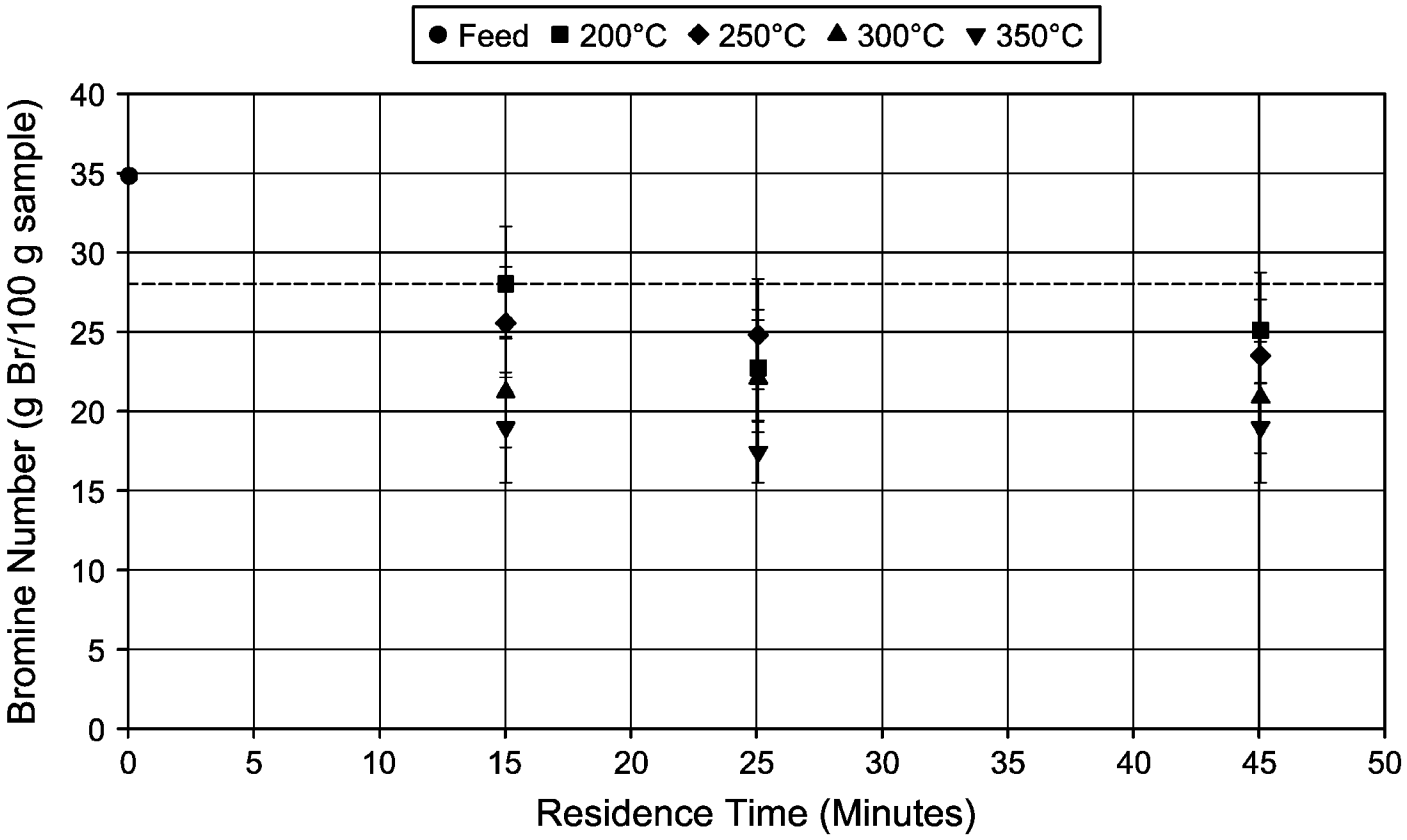
FIG. 2 is a graph of the bromine number versus thermal treatment residence time at various temperatures.

A lab scale batch thermal treatment (heat soaking) unit is used to heat soak a selected pyrolysis tar at a pressure of 1379 kPa (200 psig) in the presence of $N_2$ at a plurality of temperatures (200, 250, 300 and 350° C.) and residence times (15 minutes, 25 minutes and 45 minutes). BN is determined after each heat soaking test by a method comparable to that disclosed in the Ruzicka article. The tests results, shown in FIG. 2, indicate that in all cases heat soaking decreases pyrolysis tar BN. As shown in the figure, a greater BN decrease is generally achieved with increased heat soak time and increased heat soak temperature.

Figure 3:
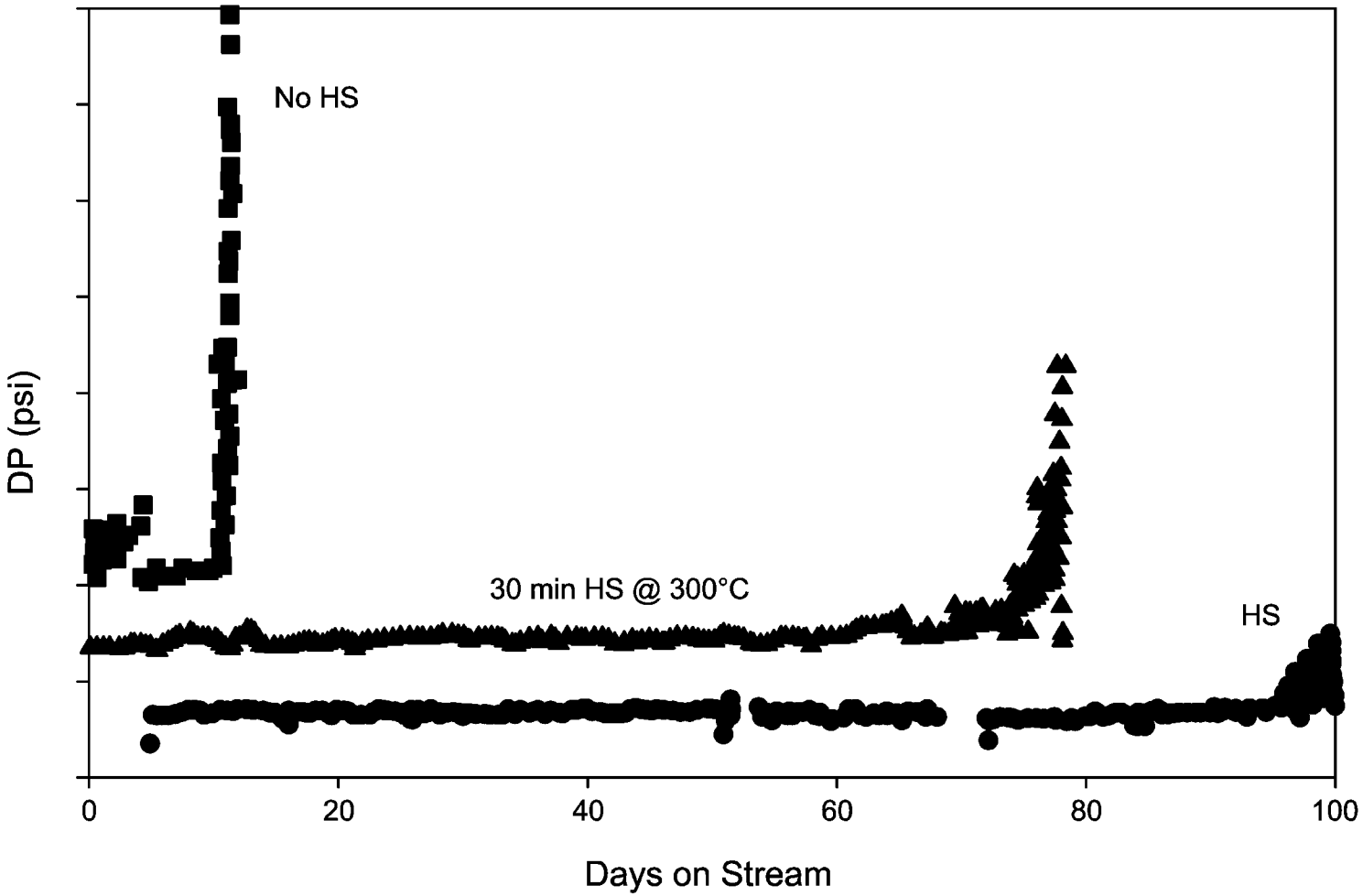
FIG. 3 is a graph of a hydroprocessing reactor pressure drop versus days on stream at standard hydroprocessing conditions for tars with no thermal treatment, and two different thermal treatment (heat soak) conditions.

Non-heat soaked and heat soaked pyrolysis tars are hydroprocessed over a bed of the specified hydroprocessing catalyst in the presence of the specified utility fluid under Standard Hydroprocessing Conditions including a hydroprocessing temperature ≥400° C., a pyrolysis tar feed WHSV of 1 $h^{-1}$. FIG. 3 is a graph of pressure drop across the hydroprocessing as a function of hydroprocessing time (in days on stream) for a representative pyrolysis tar. As shown in the figure, an increase in reactor pressure drop (an indication of reactor fouling) occurs within 15 days for the non-heat soaked pyrolysis tar, versus approximately 75 days on stream when the pyrolysis tar is heat soaked at 300° C. for a residence time of approximately 30 minutes, and approximately 95 days when the pyrolysis tar is heat soaked at 350° C. for a residence time of approximately 30 minutes.

Figure 4:
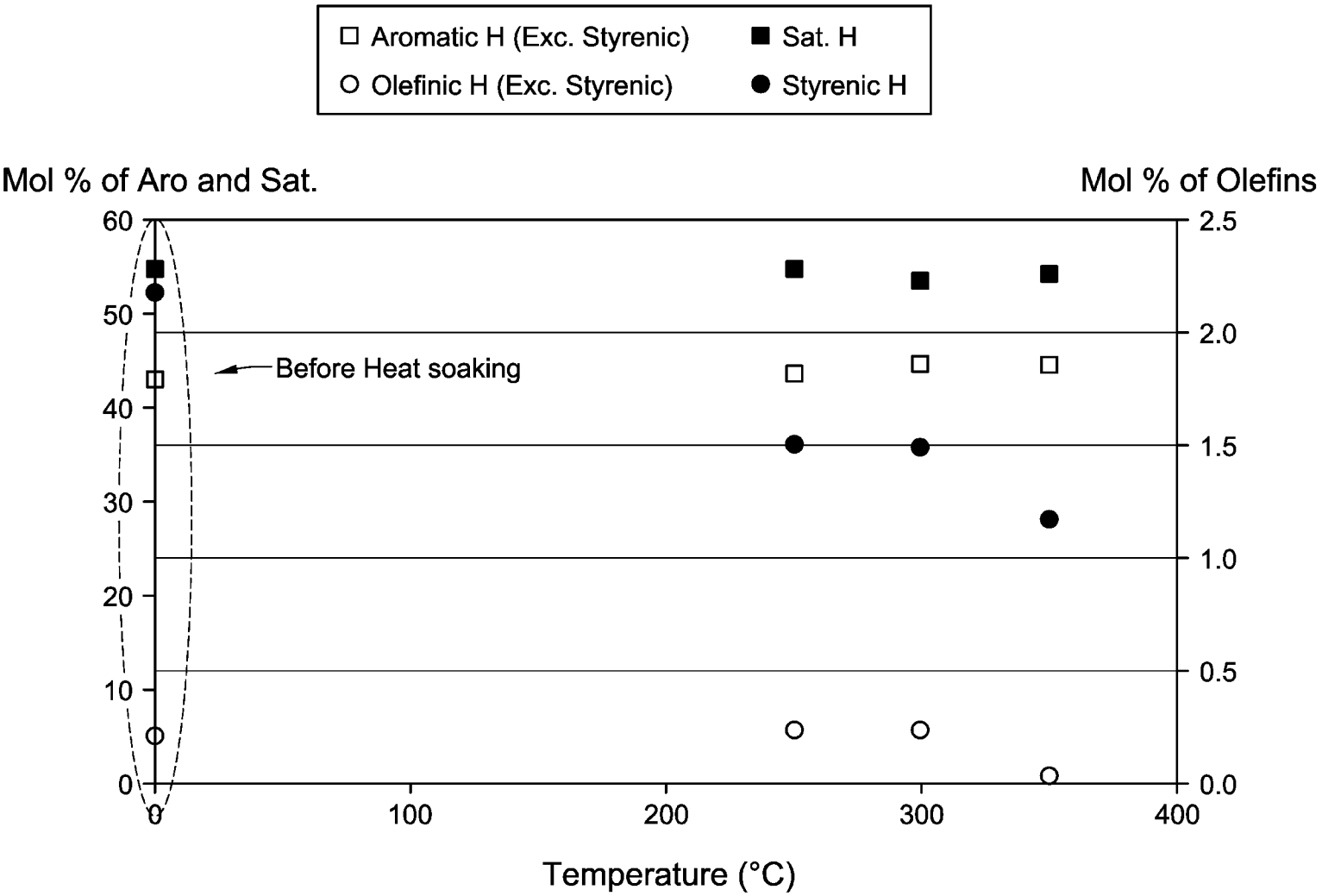
FIG. 4 is a graph of tar aliphatic olefin content (unsaturated component) versus thermal treatment conditions.

FIG. 4 shows that a desirable decrease in in aliphatic olefin content, particularly a decrease in styrenic olefin content, is achieved when the thermal treatment is carried out at a temperature ≥350° C. for a representative pyrolysis tar. As shown in the figure, the thermal treatment has the desirable feature that it does not significantly change the amount of saturated hydrocarbon and aromatic hydrocarbon in the pyrolysis tar.

All patents, test procedures, and other documents cited herein, including priority documents, are fully incorporated by reference to the extent such disclosure is not inconsistent and for all jurisdictions in which such incorporation is permitted.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

The invention claimed is:

1. A process for producing a hydroprocessed steam cracker tar ("SCT"), the process comprising:

(a) providing an SCT having a temperature $T_1$≤350° C. and a reactivity $R_T$≥28 Bromine Number units ("BN"), the SCT having a density at 15° C. ≥1.10 g/$cm^3$ and viscosity at 50° C. ≥1000 cSt, wherein at least 70 wt. % of the SCT has a normal boiling point of at least 290° C.;

(b) establishing a predetermined reference reactivity $R_{Ref}$≤18 BN;

(c) carrying out either (i) conducting away at least a portion of the SCT or hydroprocessing at least a portion of the SCT under Mild Hydroprocessing Conditions, or (ii) producing a treated SCT by carrying out one or more of (A) one or more thermal treatments of at least a portion of the SCT by heating from $T_1$ to a temperature $T_{HS}$, and maintaining the SCT at a temperature of at least $T_{HS}$ for a time $t_{HS}$ of at least 10 minutes to produce a treated SCT, wherein $T_{HS}$ is at least 10° C. greater than $T_1$ and $T_{HS}$ is in the range of 300° C. to 360° C. and $t_{HS}$ of ≥5 minutes, and (B) combining at least a portion of the SCT with a second SCT; and following steps (A) and/or (B) determining an $R_T$ of the treated SCT, and comparing $R_{Ref}$ and the $R_T$ of the treated SCT, and (I) when $R_T$ of the treated SCT exceeds 12 BN, carrying out step (c)(i) or repeating steps (c)(ii)(A) and/or step (c)(ii)(B), or (II) when $R_T$ of the treated SCT does not exceed $R_{Ref}$, then conducting the treated SCT to step (d); and (d) hydroprocessing the treated SCT, the hydroprocessing being carried out under Standard Hydroproces sing Conditions in the presence of (i) a utility fluid, (ii) at least one catalyst, and (iii) a treatment gas comprising molecular hydrogen to produce a hydroprocessor effluent comprising hydroprocessed SCT, wherein the Standard Hydroprocessing Conditions include a temperature ≥200° C., a pressure ≥8 MPa, a weight hourly space velocity ("WHSV", tar basis) ≥0.3 $hr^{-1}$, and a molecular hydrogen consumption rate (tar basis) in the range of from 270 S $m^3/m^3$ to about 534 S $m^3/m^3$.

2. The process of claim 1, wherein (i) $R_T$ and $R_{Ref}$ are determined by a Bromine Number measurement and expressed in BN units, (ii) $R_{Ref}$ is ≤10 BN, and (iii) ≥90 wt. % of the SCT has a normal boiling point ≥290° C., (iv) the SCT has a viscosity at 15° C.≥$1\times10^4$ cSt, and (v) the SCT has a density ≥1.1 g/$cm^3$.

3. The process of claim 1, wherein the utility fluid comprises two-ring and three-ring aromatics.

4. The process of claim 1, wherein hydroprocessing of step (d) exhibits a 566° C.+ conversion of at least 20 wt. % continuously for at least ten days.

5. The process of claim 1, wherein hydroprocessed SCT has a density measured at 15° C. that is at least 0.12 g/$cm^3$ less than that of the SCT.

6. The process of claim 1, wherein the catalyst is a supported hydroprocessing catalyst which includes at least one metal selected from any of Groups 5 to 10 of the Periodic Table.

7. The process of claim 1, wherein $t_{HS}$ is >20 minutes.

8. The process of claim 1, wherein $T_{HS}$<300° C.

9. The process of claim 1, wherein $T_{HS}$<250° C.

10. The process of claim 1, wherein $t_{HS}$ is <70 minutes.

11. The process of claim 1, wherein $R_T$ and $R_{Ref}$ are determined by one or more of electrochemical titration, colorimetric titration, and coulometric Karl Fischer titration.

12. The process of claim 1 wherein the reactivity $R_T$ of treated SCT conducted to step (d) is ≤18 BN.

* * * * *